US010060100B2

(12) United States Patent
Renski et al.

(10) Patent No.: US 10,060,100 B2
(45) Date of Patent: Aug. 28, 2018

(54) IMPLEMENT TOOTH ASSEMBLY WITH TIP AND ADAPTER

(71) Applicant: CATERPILLAR INC., Peoria, IL (US)

(72) Inventors: William J. Renski, Peoria, IL (US); James Robert Lahood, Peoria, IL (US); Thomas Marshall Congdon, Dunlap, IL (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/366,458

(22) Filed: Dec. 1, 2016

(65) Prior Publication Data

US 2017/0081828 A1 Mar. 23, 2017

Related U.S. Application Data

(60) Continuation of application No. 14/578,237, filed on Dec. 19, 2014, now Pat. No. 9,546,471, which is a division of application No. 13/644,429, filed on Oct. 4, 2012, now Pat. No. 8,943,716.

(60) Provisional application No. 61/545,276, filed on Oct. 10, 2011.

(51) Int. Cl.
*E02F 9/28* (2006.01)

(52) U.S. Cl.
CPC ..... *E02F 9/2825* (2013.01); *E02F 9/2808* (2013.01); *E02F 9/2833* (2013.01); *E02F 9/2858* (2013.01)

(58) Field of Classification Search
CPC ..... E02F 9/2825; E02F 9/2841; E02F 9/2858; E02F 9/2808; E02F 9/2833; E02F 9/2883; E02F 9/2816
USPC ..... 37/446, 452–460; 172/701.1–701.3, 719
See application file for complete search history.

(56) References Cited

U.S. PATENT DOCUMENTS

| | | | |
|---|---|---|---|
| 64,914 | A | 5/1867 | Selden |
| 784,116 | A | 3/1905 | McCaskey |
| 821,215 | A | 5/1906 | Cantlebery et al. |
| 915,809 | A | 3/1909 | Thomas |
| 1,218,841 | A | 3/1917 | Dietz |
| 1,363,189 | A | 12/1920 | Mulroney |

(Continued)

FOREIGN PATENT DOCUMENTS

| | | |
|---|---|---|
| AU | 652524 | 8/1994 |
| CA | 2 686 897 | 6/2010 |

(Continued)

*Primary Examiner* — Robert Eric Pezzuto
(74) *Attorney, Agent, or Firm* — Finnegan, Henderson, Farabow, Garrett & Dunner, LLP

(57) ABSTRACT

A ground engaging tooth assembly for a cutting edge of a ground engaging implement may include an adapter and a ground engaging tip. The adapter may have a forward extending adapter nose having an inverted or reverse keystone-shaped contour, with the ground engaging tip having a nose cavity for receiving the adapter nose and exterior surfaces having complementary shapes to the adapter nose. The adapter nose and an adapter cavity of the tip may also be configured with complimentary surfaces that increase retention between the adapter nose and the tip when downward forces are applied to the tip. In other embodiments, the surfaces of the tip may include reliefs extending inwardly into the body of the tip to reduce weight and facilitate penetration of the tip into work material as wear material wears away from a front edge of the tip.

15 Claims, 15 Drawing Sheets

(56) References Cited

U.S. PATENT DOCUMENTS

| | | | |
|---|---|---|---|
| 1,438,001 | A | 12/1922 | Buskirk et al. |
| 1,485,879 | A | 8/1923 | Page |
| 1,860,338 | A | 5/1932 | Taylor, Jr. |
| 1,868,247 | A | 7/1932 | Page |
| 2,040,085 | A | 5/1936 | Fykse et al. |
| 2,050,014 | A | 8/1936 | Morrison |
| 2,064,059 | A | 12/1936 | Fellmeth |
| 2,167,425 | A | 7/1939 | Page |
| 2,433,001 | A | 12/1947 | Mork |
| 2,435,846 | A | 2/1948 | Robertson |
| 2,435,847 | A | 2/1948 | Robertson |
| 2,483,032 | A | 9/1949 | Baer |
| 2,603,009 | A | 7/1952 | Smith |
| 2,688,475 | A | 9/1954 | Small |
| 2,689,419 | A | 9/1954 | Daniels et al. |
| 2,738,602 | A | 3/1956 | Meeks |
| 2,740,212 | A | 4/1956 | Werkheiser et al. |
| 2,752,702 | A | 7/1956 | Nelson |
| D182,143 | S | 2/1958 | Petersen |
| 2,846,790 | A | 8/1958 | Davis et al. |
| 2,874,491 | A | 2/1959 | Larsen |
| 2,904,909 | A | 9/1959 | Ratkowski |
| 2,915,290 | A | 12/1959 | Petersen |
| 2,919,506 | A | 1/1960 | Larsen |
| D190,335 | S | 5/1961 | Livermore |
| 2,982,035 | A | 5/1961 | Stephenson |
| 2,990,633 | A | 7/1961 | Buskirk |
| 2,994,141 | A | 8/1961 | Stephenson |
| 3,012,346 | A | 12/1961 | Larsen |
| 3,019,537 | A | 2/1962 | Stephenson |
| D193,016 | S | 6/1962 | Phillips |
| 3,063,176 | A | 11/1962 | Larson |
| D194,508 | S | 2/1963 | Cain |
| 3,079,710 | A | 3/1963 | Larsen et al. |
| D199,133 | S | 9/1964 | Wilson |
| D200,721 | S | 3/1965 | Wilson |
| D200,722 | S | 3/1965 | Wilson |
| 3,277,592 | A | 10/1966 | Launder et al. |
| D207,451 | S | 4/1967 | Wilson |
| 3,325,926 | A | 6/1967 | Wilson |
| 3,331,637 | A | 7/1967 | Krekeler |
| 3,371,437 | A | 3/1968 | Wilson et al. |
| 3,425,117 | A | 2/1969 | Hill |
| 3,444,633 | A | 5/1969 | Hensley |
| 3,455,040 | A | 7/1969 | Ratkowski |
| D215,953 | S | 11/1969 | Edwards et al. |
| 3,530,601 | A | 9/1970 | Steil |
| 3,623,247 | A | 11/1971 | Stepe |
| 3,624,827 | A | 11/1971 | Liess et al. |
| 3,650,053 | A | 3/1972 | Baer |
| 3,675,350 | A | 7/1972 | Mulcahy et al. |
| 3,708,895 | A | 1/1973 | Griffith et al. |
| 3,774,324 | A | 11/1973 | Lafond |
| 3,897,642 | A | 8/1975 | Helton et al. |
| 3,959,901 | A | 6/1976 | Klett |
| 3,982,339 | A | 9/1976 | Nilsson |
| 4,027,408 | A | 6/1977 | Ramella et al. |
| 4,050,172 | A | 9/1977 | Petersen |
| 4,083,605 | A | 4/1978 | College et al. |
| 4,103,442 | A | 8/1978 | Zepf |
| 4,317,300 | A | 3/1982 | Emrich et al. |
| 4,319,415 | A | 3/1982 | Mayerböck et al. |
| 4,326,348 | A | 4/1982 | Emrich |
| 4,329,798 | A | 5/1982 | Edwards |
| 4,335,532 | A | 6/1982 | Hahn et al. |
| 4,404,760 | A | 9/1983 | Hahn et al. |
| D274,434 | S | 6/1984 | Nilsson |
| 4,470,210 | A | 9/1984 | Hahn |
| D275,859 | S | 10/1984 | Nilsson |
| 4,481,728 | A | 11/1984 | Mulder et al. |
| 4,510,706 | A | 4/1985 | Berchem |
| 4,577,423 | A | 3/1986 | Hahn |
| 4,611,418 | A | 9/1986 | Launder |
| 4,625,439 | A | 12/1986 | Johansson et al. |
| 4,727,663 | A | 3/1988 | Hahn |
| 4,736,533 | A | 4/1988 | May et al. |
| 4,744,692 | A | 5/1988 | Olsen et al. |
| D296,442 | S | 6/1988 | Broomhall |
| 4,751,785 | A | 6/1988 | Johansson et al. |
| 4,761,900 | A | 8/1988 | Emrich |
| 4,811,505 | A | 3/1989 | Emrich |
| 4,813,491 | A | 3/1989 | Gross |
| 4,823,486 | A | 4/1989 | Diekevers et al. |
| 4,848,013 | A | 7/1989 | Bowman et al. |
| RE33,042 | E | 9/1989 | Emrich |
| 4,932,145 | A | 6/1990 | Reeves, Jr. |
| D309,460 | S | 7/1990 | Gross |
| 4,949,481 | A | 8/1990 | Fellner |
| 4,965,945 | A | 10/1990 | Emrich |
| 4,980,980 | A | 1/1991 | Schadov |
| 5,009,017 | A | 4/1991 | Diekevers et al. |
| 5,018,283 | A | 5/1991 | Fellner |
| 5,074,062 | A | 12/1991 | Hahn et al. |
| 5,111,600 | A | 5/1992 | Lukavich et al. |
| D328,466 | S | 8/1992 | Robinson |
| D329,243 | S | 9/1992 | Robinson |
| 5,144,762 | A | 9/1992 | Robinson |
| 5,152,088 | A | 10/1992 | Hahn |
| 5,177,886 | A | 1/1993 | Klett |
| 5,188,680 | A | 2/1993 | Hahn et al. |
| 5,205,057 | A | 4/1993 | Garman |
| 5,210,965 | A | 5/1993 | Funk et al. |
| D336,304 | S | 6/1993 | Robinson |
| D339,593 | S | 9/1993 | Johansson |
| D345,364 | S | 3/1994 | Robinson |
| 5,350,022 | A | 9/1994 | Launder et al. |
| D352,044 | S | 11/1994 | Hahn |
| D354,291 | S | 1/1995 | Edwards |
| 5,386,653 | A | 2/1995 | Cornelius |
| 5,423,138 | A | 6/1995 | Livesay et al. |
| D363,074 | S | 10/1995 | Ruvang |
| 5,456,029 | A | 10/1995 | Cornelius |
| 5,469,648 | A | 11/1995 | Jones et al. |
| D365,577 | S | 12/1995 | Ruvang |
| 5,561,925 | A | 10/1996 | Livesay |
| 5,653,048 | A | 8/1997 | Jones et al. |
| D385,286 | S | 10/1997 | Moreno |
| D389,843 | S | 1/1998 | Moreno |
| D389,844 | S | 1/1998 | Moreno |
| 5,709,043 | A | 1/1998 | Jones et al. |
| D391,583 | S | 3/1998 | Moreno |
| D391,584 | S | 3/1998 | Moreno |
| D392,292 | S | 3/1998 | Moreno |
| D395,661 | S | 6/1998 | Moreno |
| 5,778,570 | A | 7/1998 | Eichelberger |
| D397,697 | S | 9/1998 | Launder et al. |
| 5,802,752 | A | 9/1998 | Quarfordt |
| 5,852,888 | A | 12/1998 | Cornelius |
| D408,422 | S | 4/1999 | Moreno |
| 5,918,391 | A | 7/1999 | Viñas Peya |
| D413,338 | S | 8/1999 | Pueyo Molina |
| 5,937,550 | A | 8/1999 | Emrich |
| D414,193 | S | 9/1999 | Launder et al. |
| D417,877 | S | 12/1999 | Launder et al. |
| D420,014 | S | 2/2000 | Karlsson |
| 6,047,487 | A | 4/2000 | Clendenning |
| 6,108,950 | A | 8/2000 | Ruvang et al. |
| 6,151,812 | A | 11/2000 | Bierwith |
| D435,567 | S | 12/2000 | Clendenning |
| D436,116 | S | 1/2001 | Clendenning |
| 6,240,663 | B1 | 6/2001 | Robinson |
| 6,247,255 | B1 | 6/2001 | Clendenning |
| D446,224 | S | 8/2001 | Clendenning |
| D447,154 | S | 8/2001 | Clendenning |
| 6,321,471 | B2 | 11/2001 | Fernandez Muñoz et al. |
| D454,891 | S | 3/2002 | Ketting et al. |
| 6,393,738 | B1 | 5/2002 | Bierwith |
| D460,464 | S | 7/2002 | Ketting et al. |
| D460,764 | S | 7/2002 | Ketting et al. |
| D461,198 | S | 8/2002 | Ketting et al. |
| D461,832 | S | 8/2002 | Ketting et al. |
| 6,430,851 | B1 | 8/2002 | Clendenning |
| 6,439,796 | B1 | 8/2002 | Ruvang et al. |
| D463,460 | S | 9/2002 | Siebeck et al. |

(56) References Cited

U.S. PATENT DOCUMENTS

| | | | |
|---|---|---|---|
| 6,477,796 | B1 | 11/2002 | Cornelius |
| D471,212 | S | 3/2003 | Toral Rodriguez |
| D471,565 | S | 3/2003 | Toral Rodriguez |
| 6,619,883 | B2 | 9/2003 | Livesay et al. |
| 6,675,509 | B2 | 1/2004 | Bierwith |
| D486,836 | S | 2/2004 | Launder et al. |
| 6,708,431 | B2 | 3/2004 | Robinson et al. |
| 6,729,052 | B2 | 5/2004 | Ollinger, IV et al. |
| 6,735,890 | B2 | 5/2004 | Carpenter et al. |
| 6,745,503 | B1 | 6/2004 | Pallas Moreno et al. |
| 6,745,709 | B2 | 6/2004 | Rowlett et al. |
| 6,799,386 | B2 | 10/2004 | Robinson et al. |
| 6,836,983 | B2 | 1/2005 | Pallas Moreno et al. |
| 6,837,649 | B2 | 1/2005 | Livesay et al. |
| 6,839,990 | B2 | 1/2005 | Leslie et al. |
| 6,865,828 | B1 | 3/2005 | Molino et al. |
| 6,871,426 | B2 | 3/2005 | Keech et al. |
| 6,959,506 | B2 | 11/2005 | Adamic et al. |
| 6,976,325 | B2 | 12/2005 | Robinson et al. |
| 7,032,334 | B2 | 4/2006 | Pippins |
| 7,069,676 | B2 | 7/2006 | Robinson et al. |
| D527,029 | S | 8/2006 | Launder et al. |
| 7,100,315 | B2 | 9/2006 | Carpenter et al. |
| 7,114,272 | B2 | 10/2006 | Clendenning et al. |
| 7,121,023 | B2 | 10/2006 | Robinson et al. |
| 7,168,193 | B2 | 1/2007 | Pallas Moreno et al. |
| 7,174,661 | B2 | 2/2007 | Briscoe |
| 7,178,274 | B2 | 2/2007 | Emrich |
| D546,350 | S | 7/2007 | De Martiis |
| D552,631 | S | 10/2007 | De Martiis |
| D552,632 | S | 10/2007 | De Martiis |
| D560,232 | S | 1/2008 | De Martiis |
| D560,691 | S | 1/2008 | Launder et al. |
| 7,367,144 | B2 | 5/2008 | Jones et al. |
| D576,183 | S | 9/2008 | De Martiis |
| 7,523,572 | B2 | 4/2009 | Pasqualini |
| 7,578,081 | B2 | 8/2009 | Bearden et al. |
| D600,723 | S | 9/2009 | Bartolome |
| D602,505 | S | 10/2009 | Ruvang |
| 7,640,684 | B2 | 1/2010 | Adamic et al. |
| 7,640,685 | B2 | 1/2010 | Emrich |
| 7,658,025 | B2 | 2/2010 | Bentley |
| D614,206 | S | 4/2010 | Ruvang |
| D614,207 | S | 4/2010 | Ruvang |
| 7,703,224 | B2 | 4/2010 | Karlsson et al. |
| 7,707,755 | B2 | 5/2010 | Lopez Almendros et al. |
| 7,730,651 | B2 | 6/2010 | Carpenter |
| 7,739,814 | B2 | 6/2010 | Carpenter et al. |
| 7,757,778 | B2 | 7/2010 | Calderwood |
| 7,762,015 | B2 | 7/2010 | Smith et al. |
| 7,788,830 | B2 | 9/2010 | Woerman et al. |
| D624,943 | S | 10/2010 | Gibbon |
| 7,818,902 | B2 | 10/2010 | Launder et al. |
| 7,832,129 | B2 | 11/2010 | Briscoe |
| 7,874,086 | B2 | 1/2011 | Briscoe et al. |
| 7,882,649 | B2 | 2/2011 | Carpenter et al. |
| 7,926,207 | B2 | 4/2011 | Lopez Almendros et al. |
| 7,980,011 | B2 | 7/2011 | Ruvang |
| 8,061,064 | B2 | 11/2011 | Ollinger, IV et al. |
| 8,104,200 | B2 | 1/2012 | Briscoe |
| 8,117,772 | B2 | 2/2012 | Harder et al. |
| 8,122,621 | B2 | 2/2012 | Carpenter et al. |
| 8,122,622 | B2 | 2/2012 | Smith et al. |
| 8,122,623 | B1 | 2/2012 | Hughes |
| 8,127,475 | B2 | 3/2012 | Harder et al. |
| 8,166,678 | B2 | 5/2012 | Martinez et al. |
| 8,191,291 | B2 * | 6/2012 | Vanderpoorten ..... E02F 9/2858 37/453 |
| 2001/0001352 | A1 | 5/2001 | Fernandez Munoz et al. |
| 2002/0133986 | A1 | 9/2002 | Bierwith |
| 2003/0005606 | A1 | 1/2003 | Carpenter et al. |
| 2003/0024139 | A1 | 2/2003 | Jones et al. |
| 2003/0041486 | A1 | 3/2003 | Creighton |
| 2003/0070330 | A1 | 4/2003 | Olds et al. |
| 2003/0101627 | A1 | 6/2003 | Robinson et al. |
| 2004/0010949 | A1 | 1/2004 | Laguarda et al. |
| 2004/0093771 | A1 | 5/2004 | Carpenter et al. |
| 2004/0107608 | A1 | 6/2004 | Meyers et al. |
| 2004/0111927 | A1 | 6/2004 | Livesay et al. |
| 2004/0118021 | A1 | 6/2004 | Renski |
| 2004/0244235 | A1 | 12/2004 | Molino et al. |
| 2005/0050775 | A1 | 3/2005 | Glendenning et al. |
| 2005/0055853 | A1 | 3/2005 | Livesay et al. |
| 2005/0120596 | A1 | 6/2005 | Kasim |
| 2005/0132619 | A1 | 6/2005 | Robinson |
| 2006/0010725 | A1 | 1/2006 | Jackson |
| 2006/0013648 | A1 | 1/2006 | Bernstein |
| 2006/0236567 | A1 | 10/2006 | Adamic |
| 2007/0227051 | A1 | 10/2007 | Carpenter et al. |
| 2007/0245601 | A1 | 10/2007 | Beardon et al. |
| 2007/0256335 | A1 | 11/2007 | De Martiis |
| 2008/0000114 | A1 | 1/2008 | Bentley |
| 2008/0028644 | A1 | 2/2008 | Lopez Almendros et al. |
| 2008/0066351 | A1 | 3/2008 | Simmons et al. |
| 2008/0196281 | A1 | 8/2008 | Livesay et al. |
| 2008/0201997 | A1 | 8/2008 | Armstrong |
| 2008/0209772 | A1 | 9/2008 | Cui |
| 2008/0256832 | A1 | 10/2008 | Esti |
| 2009/0165339 | A1 | 7/2009 | Watanabe |
| 2009/0277050 | A1 | 11/2009 | Ollinger, IV et al. |
| 2010/0115804 | A1 | 5/2010 | Lopez Almendros et al. |
| 2010/0170119 | A1 | 7/2010 | Lopez Almendros et al. |
| 2010/0236108 | A1 | 9/2010 | Ruvang |
| 2011/0000109 | A1 | 1/2011 | Woerman et al. |
| 2011/0058894 | A1 | 3/2011 | Heaphy et al. |
| 2011/0061271 | A1 | 3/2011 | Bierwith |
| 2011/0072693 | A1 | 3/2011 | Knight |
| 2011/0099861 | A1 | 5/2011 | Ollinger, IV et al. |
| 2011/0099862 | A1 | 5/2011 | Snyder |
| 2012/0017474 | A1 | 1/2012 | Rol Corredor et al. |
| 2012/0023788 | A1 | 2/2012 | Ollinger, IV et al. |
| 2012/0055052 | A1 | 3/2012 | Campomanes et al. |
| 2012/0102790 | A1 | 5/2012 | Ruvang |
| 2013/0086826 | A1 | 4/2013 | Renski |
| 2013/0086827 | A1 | 4/2013 | Renski |
| 2013/0086828 | A1 | 4/2013 | Renski |

FOREIGN PATENT DOCUMENTS

| | | |
|---|---|---|
| CN | 1 304 472 | 7/2001 |
| CN | 1 748 063 | 3/2006 |
| CN | 101851943 | 6/2010 |
| DE | 1912098 | 9/1970 |
| DE | 2439094 | 2/1975 |
| DE | 3140436 | 4/1983 |
| DE | 3442747 | 5/1986 |
| DE | 3538156 | 7/1986 |
| DE | 3720855 | 2/1988 |
| DE | 9419318 | 3/1995 |
| DE | 202011101484 | 1/2012 |
| EP | 0270325 | 6/1988 |
| EP | 0411486 | 2/1991 |
| EP | 1103664 | 5/2001 |
| EP | 1154082 | 11/2001 |
| EP | 1174546 | 1/2002 |
| EP | 1239088 | 9/2002 |
| EP | 1331314 | 7/2003 |
| EP | 1361313 | 11/2003 |
| EP | 1710358 | 10/2006 |
| EP | 1852557 | 11/2007 |
| EP | 2011927 | 1/2009 |
| FR | 2209871 | 7/1974 |
| FR | 2240988 | 3/1975 |
| FR | 2669658 | 5/1992 |
| GB | 1349442 | 4/1974 |
| GB | 2080761 | 2/1982 |
| GB | 2132980 | 7/1984 |
| GB | 2151207 | 7/1985 |
| GB | 2157650 | 10/1985 |
| GB | 2106075 | 4/1993 |
| JP | 49082103 | 8/1974 |
| JP | 53089203 | 8/1978 |
| JP | 58010962 | 7/1981 |
| JP | 59106629 | 6/1984 |

(56) References Cited

FOREIGN PATENT DOCUMENTS

| | | |
|---|---|---|
| JP | 59156947 | 10/1984 |
| JP | 61176724 | 8/1986 |
| JP | 3059229 | 3/1991 |
| JP | 04266438 | 9/1992 |
| JP | 4306329 | 10/1992 |
| JP | 8253958 | 10/1996 |
| JP | 10183698 | 7/1998 |
| JP | 159157 | 6/2001 |
| JP | 517646 | 6/2002 |
| SU | 883286 | 11/1981 |
| WO | WO 87/03316 | 6/1987 |
| WO | WO 88/05483 | 7/1988 |
| WO | WO 95/29298 | 11/1995 |
| WO | WO 97/21880 | 6/1997 |
| WO | WO 01/29331 | 4/2001 |
| WO | WO 02/04750 | 1/2002 |
| WO | WO 03/080946 | 10/2003 |
| WO | WO 2004/035945 | 4/2004 |
| WO | WO 2005/056934 | 6/2005 |
| WO | WO 2005/080695 | 9/2005 |
| WO | WO 2006/012689 | 2/2006 |
| WO | WO 2007/123653 | 11/2007 |
| WO | WO 2008/021376 | 2/2008 |
| WO | WO 2008/140993 | 11/2008 |
| WO | WO 2009/127016 | 10/2009 |
| WO | WO 2010/006382 | 1/2010 |
| WO | WO 2010/031124 | 3/2010 |
| WO | WO 2010/049546 | 5/2010 |
| WO | WO 2010/089423 | 8/2010 |
| WO | WO 2011/074983 | 6/2011 |
| WO | WO 2011/088506 | 7/2011 |
| WO | WO 2011/088507 | 7/2011 |
| WO | WO 2011/088511 | 7/2011 |
| WO | WO 2011/134014 | 11/2011 |

* cited by examiner

IMPLEMENT TOOTH ASSEMBLY WITH TIP AND ADAPTER

CROSS-REFERENCE TO RELATED APPLICATIONS

This application is continuation of U.S. patent application Ser. No. 14/578,237, filed Dec. 19, 2014, which is a divisional of U.S. patent application Ser. No. 13/644,429, filed Oct. 4, 2012, now U.S. Pat. No. 8,943,716, issued Feb. 3, 2015, and entitled "IMPLEMENT TOOTH ASSEMBLY WITH TIP AND ADAPTER," which is based upon and claims the benefit of priority under 35 U.S.C. § 119(e) of U.S. Provisional Application No. 61/545,276 to Renski et al. filed on Oct. 10, 2011. The entire contents of all of the aforementioned applications are incorporated herein by reference.

TECHNICAL FIELD

This disclosure relates generally to earth working machines with ground engaging implements and, in particular, to tooth assemblies with replaceable tip and adapter systems attached to the leading or base edges of such ground engaging implements.

BACKGROUND

Earth moving machines known in the art are used for digging into the earth or rock and moving loosened work material from one place to another at a worksite. These machines and equipment typically include a body portion housing the engine and having rear wheels, tracks or similar components driven by the engine, and an elevated cab for the operator. The machines and equipment further include articulating mechanical arms or other types of linkages, such as Z-bar linkages, for manipulating one or more implements of the machine. The linkages are capable of raising and lowering the implements and rotating the implements to engage the ground or other work material in a desired manner. In the earth moving applications, the implements of the machines or other equipment are buckets provided with a beveled lip or blade on a base edge for moving or excavating dirt or other types of work material.

To facilitate the earth moving process, and to prolong the useful life of the implement, a plurality of tooth assemblies are spaced along the base edge of the implement and attached to the surface of the implement. The tooth assemblies project forward from the base edge as a first point of contact and penetration with work material, and to reduce the amount of wear of the base edge. With this arrangement, the tooth assemblies are subjected to the wear and breakage caused by repetitive engagement with the work material. Eventually, the tooth assemblies must be replaced, but the implement remains usable through multiple cycles of replacement tooth assemblies. Depending on the variety of uses and work material for the equipment, it may also be desirable to change the type or shape of the tooth assemblies to most effectively utilize the implement.

In many implementations, installation and replacement of the tooth assemblies may be facilitated by providing the tooth assemblies as a two-part system. The system may include an adapter that is attached to the base edge of the implement, a ground-engaging tip configured to be attached to the adapter, and a retention mechanism securing the tip to the adapter during use. The adapter may be welded, bolted or otherwise secured to the base edge, and then the tip may be attached to the adapter and held in place by the retention mechanism. The tip endures the majority of the impact and abrasion caused by engagement with the work material, and wears down more quickly and breaks more frequently than the adapter. Consequently, multiple tips may be attached to the adapter, worn down, and replaced before the adapter itself must be replaced. Eventually, the adapter may wear down and require replacement before the base edge of the implement wears out.

One example of a digging tooth assembly is illustrated and described in U.S. Pat. No. 4,949,481 to Fellner. The digging tooth for a bucket has a concave top surface and a convex bottom surface which intersect forming a forward cutting edge. Sidewalls connect the two surfaces and are concave having a moldboard shape. The rear portion of the tooth is provided with a mounting assembly for mounting the digging tooth to a bucket. The bottom surface continuously diverges from the forward cutting edge to the rear portion; whereas the top surface first converges then diverges from the forward cutting edge to the rear portion. The rear portion includes a shank receiving cavity with top and bottom walls that converge as the cavity extends forwardly within the tooth to give the cavity a triangular or wedge shape when viewed in profile.

An example of a loader bucket tooth is provided in U.S. Pat. No. 5,018,283 to Fellner. The digging tooth for a loader bucket includes a top surface having a concave configuration and a bottom surface having a flat forward portion and a convex rear portion. The flat forward portion and the top surface intersect to form a forward cutting edge. Sidewalls connect the two surfaces and are concave having a plowshare shape. The rear portion of the tooth is provided with a mounting assembly for mounting it to a bucket. The bottom surface continuously converges from the forward cutting edge to the rear portion; whereas the top surface first converges then diverges from the forward cutting edge to the rear portion. The rear portion includes a shank receiving cavity with bottom wall extending inwardly, and a top wall having a first portion extending approximately parallel to the bottom wall and a second portion angled toward the bottom wall and extending to a rounded front portion.

U.S. Pat. No. 2,982,035 to Stephenson provides an example of an excavator tooth having an adapter that attaches to the leading edge of a dipper body, and a tip that attaches to the adapter. The tip includes an upper surface and a lower surface that converge into a relatively sharp point, with the tip having a horizontal plane of symmetry. Upper and lower surfaces of the adapter have recessed central surfaces, with the upper central surface having a forward surface that diverges upwardly from the plane of symmetry and rounds into a forward surface of the adapter. The interior of the tip has corresponding planar surfaces that are received by the central surfaces of the adapter, and include forward surfaces diverging from the plane of symmetry as they approach a forward surface, with one of the forward surfaces of the tip abutting the forward surface of the adapter when the parts are appropriately assembled.

The implements as discussed may be used in a variety of applications having differing operating conditions. In loader applications, buckets installed on the front of wheel or track loaders have the bottom surfaces and base edges scrape along the ground and dig into the earth or pile of work material as the loader machine is driven forward. The forces on the tooth assembly as the bucket enters the pile push the tip into engagement with the corresponding adapter. The bucket is then raised and racked with the load of work material, and the loader moves and dumps the work material in another location. As the bucket is raised through the work material, force is exerted downwardly on the tooth assembly. With the combination of scraping and engagement with the work material, and in other types of bottom-wearing applications in which the bottom surface typically wears more quickly due to more frequent engagement with the work material, the wear material of the tip wears away from the front of the tip and from the bottom surface of the tip and adapter. The loss of wear material at the front of the tip converts the initially pointed front end of the tip into a rounded, blunt surface, similar to changing the hand from having extended fingers to having a closed fist. The worn down shape is less efficient at digging through the work material as the loader moves forward, though the tip may still have sufficient wear material to be used on the implement for a time before replacement.

In excavator applications and other types of top-wearing applications where the top surface typically wears more quickly due to more frequent engagement with the work material, the buckets engage and pass through the ground or work material at different angles than in bottom-wearing applications such as loader applications described above, and therefore cause wear material of the tooth assemblies to wear away in a different manner. An excavator device, such as a backhoe, initially engages the work material with the base edge and tooth assemblies oriented close to perpendicular with respect to the surface of the work material and generally enter the work material in a downward motion. After the initial penetration into the work material, the mechanical arm further breaks up the work material and collects a load of work material in the bucket by drawing the bucket back toward the excavator machine and rotating the bucket inwardly to scoop the work material into the bucket. The complex motion of the bucket causes wear at the tip of the tooth assembly during the downward penetration motion when the threes act to push the tip into engagement with the adapter. After the initial penetration, the bucket is drawn toward the machine and rotated to further in a scooping motion to break up the work material and begin to load the implement. During this motion, the forces initially act in a direction that is normal to the top surface of the tooth assembly, and the work material passes over and around the top of the tooth causing wear on the top surface of the tooth. As the implement rotates further and is drawn through the work material, the forces and work material again act on the tip of the tooth to cause wear at the tip. As with the loader tooth assemblies, the excavator tooth assemblies wear down to less efficient shapes after repeated forays into the work material, but may still retain sufficient wear material for continued use without replacement. In view of this, a need exists for improved tooth assembly designs for loader and excavator implements that distribute the wear material such that the tips dig into the work material more efficiently as wear material wears away from and reshapes the tips until the tips ultimately must be replaced.

SUMMARY OF THE DISCLOSURE

In one aspect of the present disclosure, the invention is directed to a ground engaging tip of a tooth assembly for a cutting edge of a ground engaging implement, wherein the tooth assembly includes an adapter configured for attachment to a base edge of the ground engaging implement and having a forwardly extending adapter nose. The ground engaging tip may include a rear edge, a top outer surface, a bottom outer surface, wherein the top outer surface and the bottom outer surface extend forward from the rear edge and converge at a front edge, and oppositely disposed lateral outer surfaces extending upwardly from the bottom outer surface to the top outer surface. The ground engaging tip may further include an inner surface extending inwardly into the ground engaging tip from the rear edge and defining a nose cavity within the ground engaging tip having a complementary shape to the adapter nose of the adapter for receiving the adapter nose therein, and a pair of reliefs, each relief extending inwardly into the ground engaging tip from a corresponding one of the lateral outer surfaces, and wherein each relief is disposed proximate the front edge.

In another aspect of the present disclosure, the invention is directed to a ground engaging tip of a tooth assembly for a cutting edge of a ground engaging implement, wherein the tooth assembly includes an adapter configured for attachment to a base edge of the ground engaging implement and having a forwardly extending adapter nose. The ground engaging tip may include a rear edge, a top outer surface, a bottom outer surface, wherein the top outer surface and the bottom outer surface extend forward from the rear edge and converge at a forward front edge, oppositely disposed lateral outer surfaces extending upwardly from the bottom outer surface to the top outer surface, and an inner surface extending inwardly into the ground engaging tip from the rear edge and defining a nose cavity within the ground engaging tip having a complementary shape to the adapter nose of the adapter for receiving the adapter nose therein. The inner surface may include a bottom inner surface, a front inner surface, a top inner surface having a first support portion proximate the front inner surface, a second support portion proximate the rear edge of the ground engaging tip, and an intermediate portion extending between the first support portion and the second support portion, where a distance between the first support portion and the bottom inner surface is less than a distance between the second support portion and the bottom inner surface, and oppositely disposed side inner surfaces extending upwardly from the bottom inner surface to the top inner surface.

In a further aspect of the present disclosure, the invention is directed to a ground engaging tip of a tooth assembly for a cutting edge of a ground engaging implement, wherein the tooth assembly includes an adapter configured for attachment to a base edge of the ground engaging implement and having a forwardly extending adapter nose. The ground engaging tip may include a rear edge, a top outer surface, a bottom outer surface, wherein the top outer surface and the bottom outer surface extend forward from the rear edge and converge at a front edge, oppositely disposed lateral outer surfaces extending upwardly from the bottom outer surface to the top outer surface, wherein the lateral outer surfaces are tapered so that a distance between the lateral outer surfaces decreases as the lateral outer surfaces extend upwardly from the bottom outer surface toward the top outer surface, and an inner surface extending inwardly into the ground engaging tip from the rear edge and defining a nose cavity within the ground engaging tip having a complementary shape to the adapter nose of the adapter for receiving the adapter nose therein.

In a still further aspect of the present disclosure, the invention is directed to a adapter of a tooth assembly for a cutting edge of a ground engaging implement. The adapter may include a rearwardly extending top strap, a rearwardly extending bottom strap, wherein the top strap and the bottom strap define a gap there between for receiving the cutting edge of the ground engaging implement, and a forward extending adapter nose. The adapter nose may include a bottom surface, a front surface, a top surface having a first support surface proximate the front surface, a second support surface proximate the top strap and the bottom strap, and an intermediate surface extending between the first support surface and the second support surface, where a distance between the first support surface and the bottom surface is less than a distance between the second support surface and the bottom surface, and oppositely disposed side surfaces extending upwardly from the bottom surface to the top surface.

In yet another aspect of the present disclosure, the invention is directed to a ground engaging tooth assembly for a cutting edge of a ground engaging implement that may include an adapter and a ground engaging tip. The adapter may include a rearwardly extending top strap, a rearwardly extending bottom strap, wherein the top strap and the bottom strap define a gap there between for receiving the cutting edge of the ground engaging implement, and a forward extending adapter nose. The adapter nose may include a bottom surface, a front surface, a top surface having a first support surface proximate the front surface, a second support surface proximate the top strap and the bottom strap, and an intermediate surface extending between the first support surface and the second support surface, where a distance between the first support surface and the bottom surface is less than a distance between the second support surface and the bottom surface, and oppositely disposed side surfaces extending upwardly from the bottom surface to the top surface. The ground engaging tip may include a rear edge, a top outer surface, a bottom outer surface, wherein the top outer surface and the bottom outer surface extend forward from the rear edge and converge at a forward front edge, oppositely disposed lateral outer surfaces extending upwardly from the bottom outer surface to the top outer surface, and an inner surface extending inwardly into the ground engaging tip from the rear edge and defining a nose cavity within the ground engaging tip having a complementary shape to the adapter nose of the adapter for receiving the adapter nose therein.

Additional aspects of the invention are defined by the claims of this patent.

DETAILED DESCRIPTION

Although the following text sets forth a detailed description of numerous different embodiments of the invention, it should be understood that the legal scope of the invention is defined by the words of the claims. The detailed description is to be construed as exemplary only and does not describe every possible embodiment of the invention. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent other than the language of the claims. To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
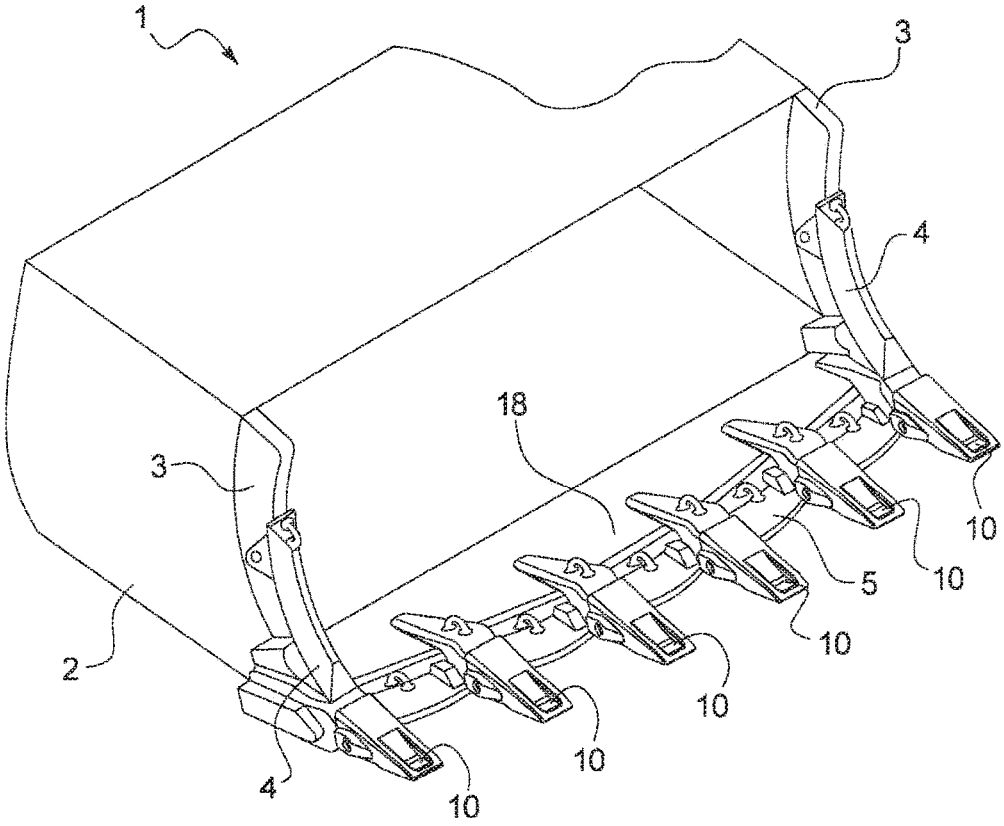
FIG. 1 is an isometric view of a loader bucket having tooth assemblies in accordance with the present disclosure attached at a base edge thereof.
Figure 2:
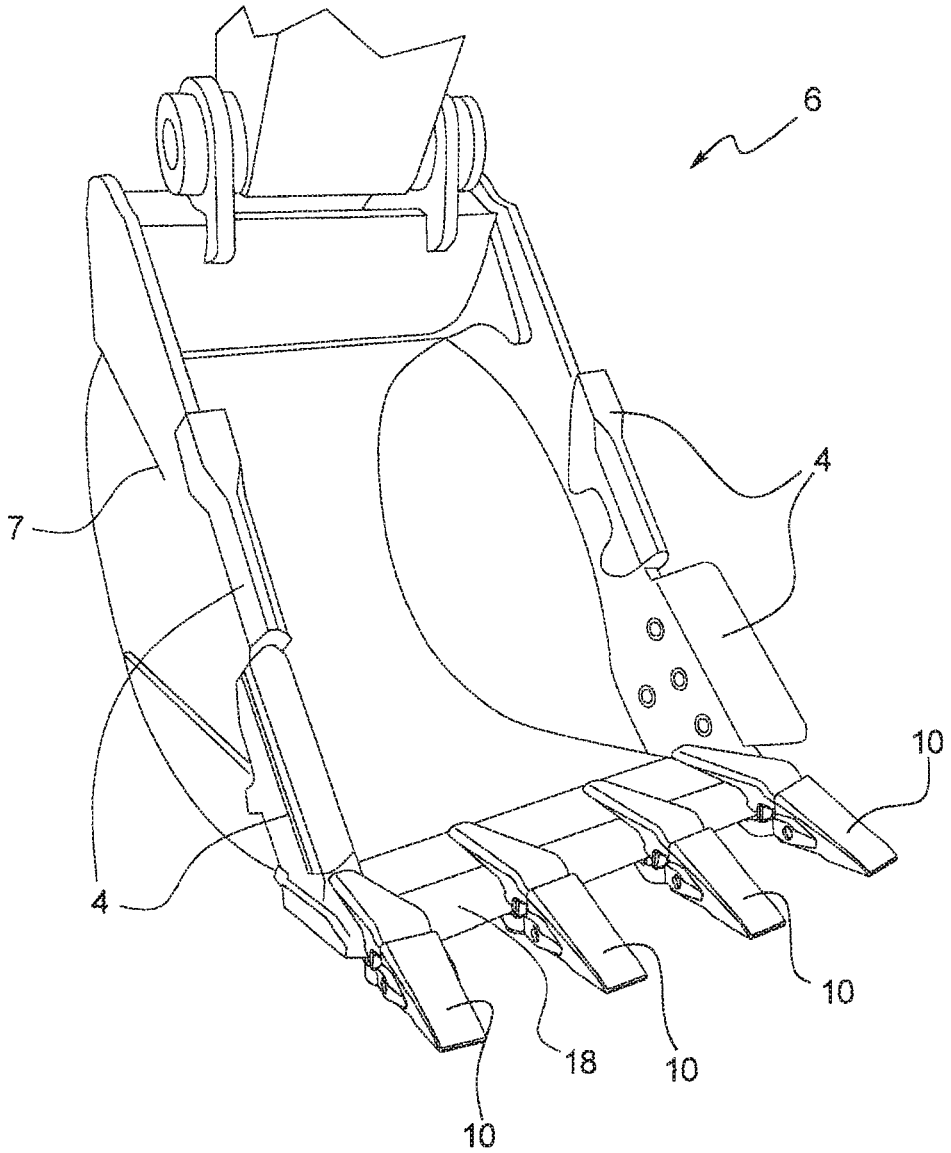
FIG. 2 is an isometric view of an excavator bucket having tooth assemblies in accordance with the present disclosure attached at a base edge thereof.

Referring now to FIG. 1, there is shown an implement for a bottom-wearing application, such as a loader machine, in the form of a loader bucket assembly 1 that incorporates the features of the present disclosure. The loader bucket assembly 1 includes a bucket 2 which is partially shown in FIG. 1. The bucket 2 is used on the loader machine to excavate work material in a known manner. The bucket assembly 10 may include a pair of oppositely-disposed support arms 3 on which corresponding corner guards 4 may be mounted. The bucket assembly 10 may further included a number of edge protector assemblies 5 interposed between tooth assemblies 10 in accordance with the present disclosure, with the edge protector assemblies 5 and the tooth assemblies being secured along a base edge 18 of the bucket 2. FIG. 2 illustrates an implement for a top-wearing application, such as an excavator, in the form of an excavator bucket assembly 6. The excavator bucket assembly 6 includes an excavator bucket 7 having corner guards 4 connected on either side, and a plurality of tooth assemblies 10 attached across the base edge 18 of the bucket 7. Various embodiments of tooth assemblies are described herein that may be implemented in bottom-wearing and top-wearing applications. Even where a particular tooth assembly or component embodiment may be described with respect to a particular bottom-wearing or top-wearing application, those skilled in the art will understand that the tooth assemblies are not limited to a particular type of application and may be interchangeable between implements of various applications, and such interchangeability is contemplated by the inventors for tooth assemblies in accordance with the present disclosure.

Figure 3:
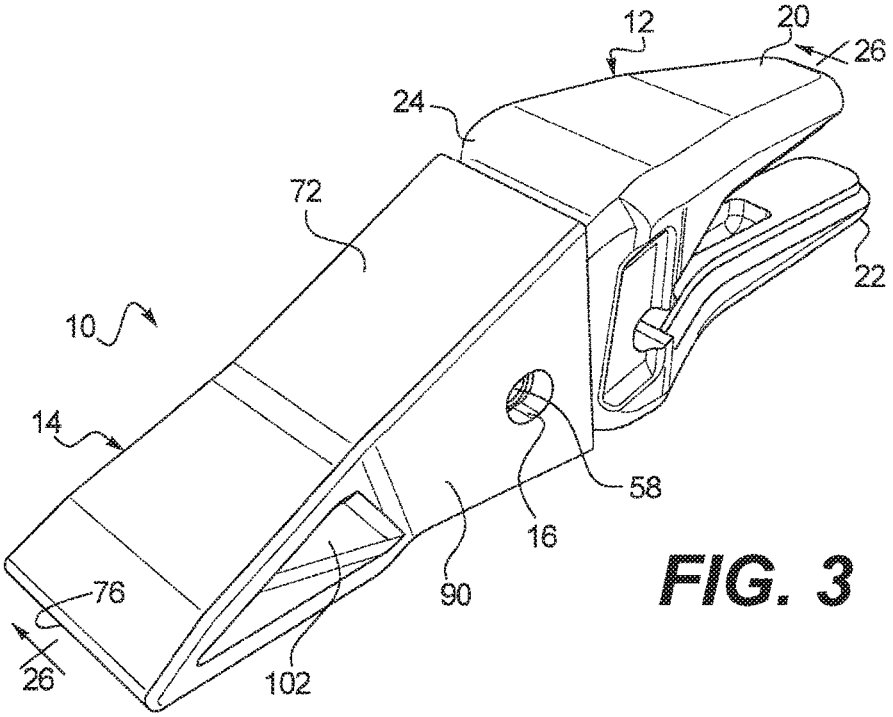
FIG. 3 is an isometric view of a tooth assembly in accordance with the present disclosure.
Figure 4:
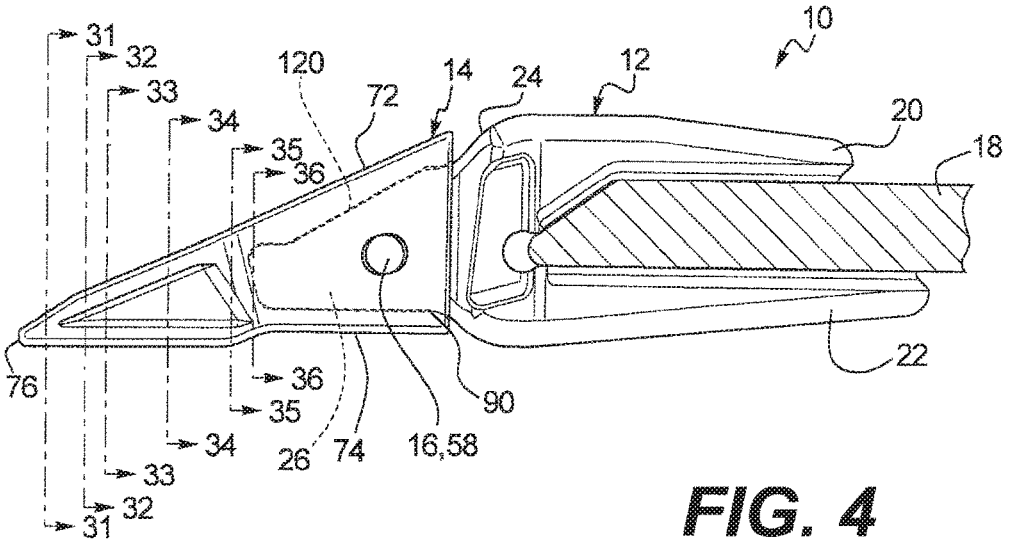
FIG. 4 is a side view of the tooth assembly of FIG. 3.

FIGS. 3 and 4 illustrate an embodiment of a tooth assembly 10 in accordance with the present disclosure that may be useful with earth moving implements, and have particular use in bottom-wearing applications. However, the tooth assembly 10 may be used other types of ground engaging implements having base edges 18. The tooth assembly 10 includes an adapter 12 configured for attachment to a base edge 18 of an implement 1, 6 (FIGS. 1 and 2, respectively), and a tip 14 configured for attachment to the adapter 12. The tooth assembly 10 further includes a retention mechanism (not shown) securing the tip 14 to the adapter 12. The retention mechanisms may utilize aspects of the adapter 12 and tip 14, such as retention apertures 16 through the sides of the tip 14, but those skilled in the art will understand that many alternative retention mechanisms may be implemented in the tooth assemblies 10 according to the present disclosure, and the tooth assemblies 10 are not limited to any particular retention mechanism(s). As shown in FIG. 4, once attached to the adapter 12, the tip 14 may extended outwardly from a base edge 18 of the implement 1, 6 for initial engagement with the work material (not shown).

Adapter for Bottom-Wearing Applications (FIGS. 5-9)

Figure 5:
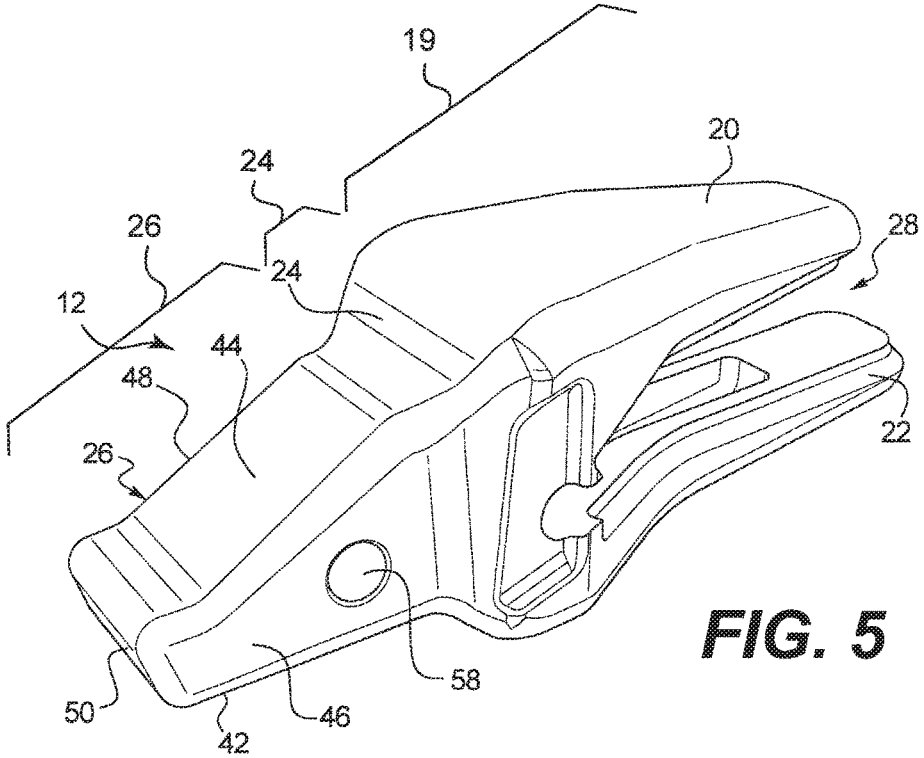
FIG. 5 is an isometric view of an adapter of the tooth assembly of FIG. 3.
Figure 6:
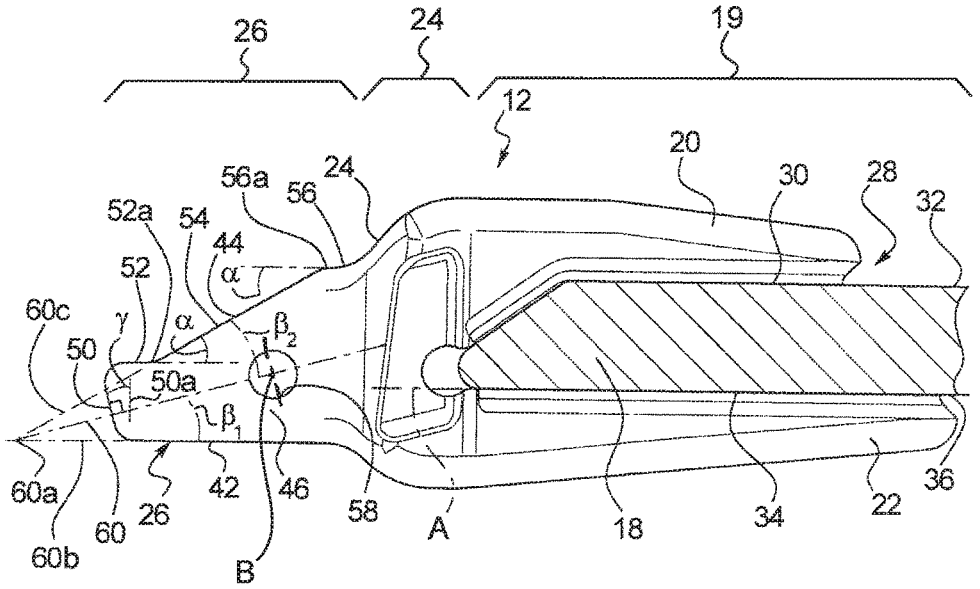
FIG. 6 is a side view of the adapter of FIG. 5 attached to a base edge of an implement.

An embodiment of the adapter 12 is shown in greater detail in FIGS. 5-9. Referring to FIG. 5, the adapter 12 may include a rear portion 19 having a top strap 20 and a bottom strap 22, an intermediate portion 24, and a nose 26 disposed at the front or forward position of the adapter 12 as indicated by the brackets. The top strap 20 and the bottom strap 22 may define a gap 28 therebetween as shown in FIG. 6 for receiving the base edge 18 of the implement 1, 6. The top strap 20 may have a bottom surface 30 that may face and be disposed proximate to a top surface 32 of the base edge 18, and the bottom strap 22 may have a top surface 34 that may face and engage a bottom surface 36 of the base edge 18.

Figure 7:
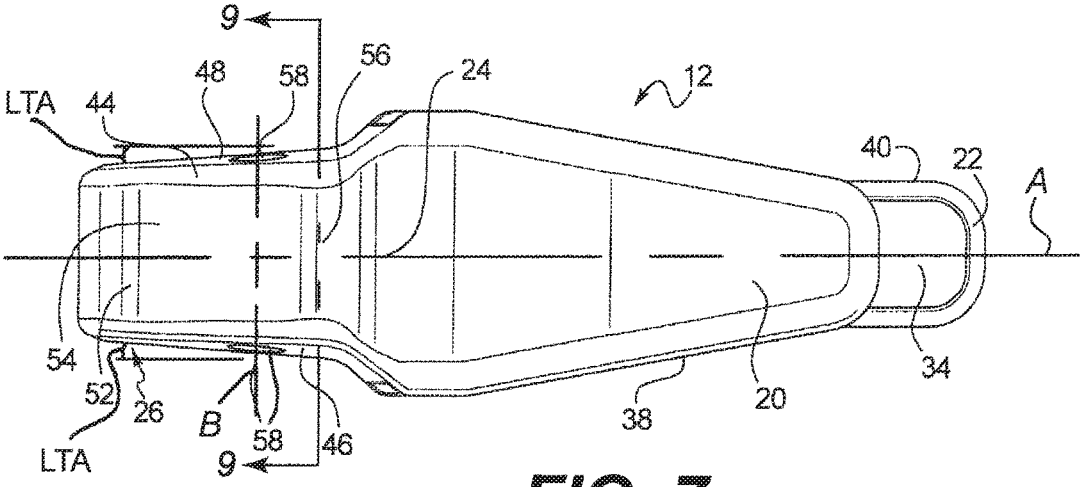
FIG. 7 is a top view of the adapter of FIG. 5.
Figure 8:
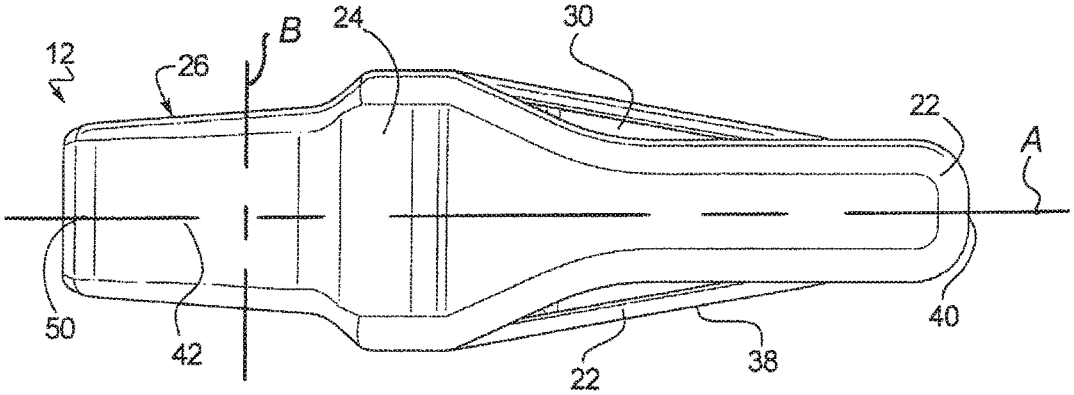
FIG. 8 is a bottom view of the adapter of FIG. 5.
Figure 9:
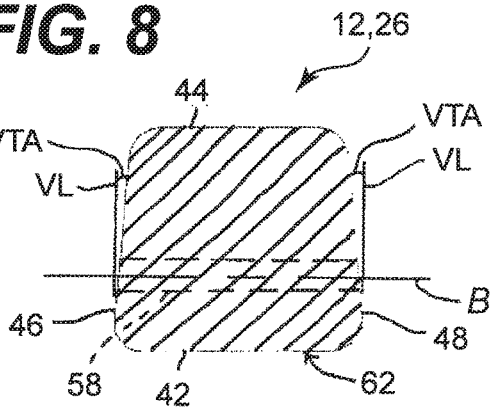
FIG. 9 is a cross-sectional view of the adapter of FIG. 5 taken through line 9-9 of FIG. 7.

The adapter 12 may be secured in place on the base edge 18 of the implement 1, 6 by attaching the top strap 20 and the bottom strap 22 to the base edge 18 using any connection method or mechanism known to those skilled in the art. In one embodiment, the straps 20, 22 and the base edge 18 may have corresponding apertures (not shown) through which fasteners (not shown) such as bolts or rivets may be inserted to hold the adapter 12 in place. Alternatively, the top and bottom straps 20, 22 may be welded to the corresponding top and bottom surfaces 32, 36 of the base edge 18 so that the adapter 12 and the base edge 18 do not move relative to each other during use. To reduce the impact of the top and bottom surface welds on the strength of the metal of the base edge 18, the straps 20, 22 may be configured with different shapes so as to minimize the overlap of the welds formed on the top surface 32 and bottom surface 36 of the base edge 18. As seen in FIGS. 7 and 8, an outer edge 38 of the top strap 20 may have a different shape than an outer edge 40 of the bottom strap 22 so that the top strap 20 may generally be shorter and wider than the bottom strap 22. In addition to the strength maintenance benefits, the additional length of the bottom strap 22 may also provide additional wear material at the bottom surface 36 of the base edge 18 of the implement 1, 6 where a greater amount of abrasion occurs in top-wearing applications.

Those skilled in the art will understand that other connection configurations for the adapter 12 may be provide as alternatives to the top and bottom straps 20, 22 illustrated and described above. For example, the rear portion of the adapter 12 may be provided with a single top strap 20 and no bottom strap 22, with the top strap 20 being attached to the top surface 32 of the base edge 18. Conversely, a single bottom strap 22 and no top strap 20 may be provided, with the bottom strap 22 being attached to the bottom surface 36 of the base edge 18. As a further alternative, a single center strap may be provided on the rear portion of the adapter 12, with the center strap being inserted into a gap in the base edge 18 of the implement 1, 6. Further alternative adapter attachment configurations will be apparent to those skilled in the art, and are contemplated by the inventor as having use in tooth assemblies in accordance with the present disclosure.

Figure 16:
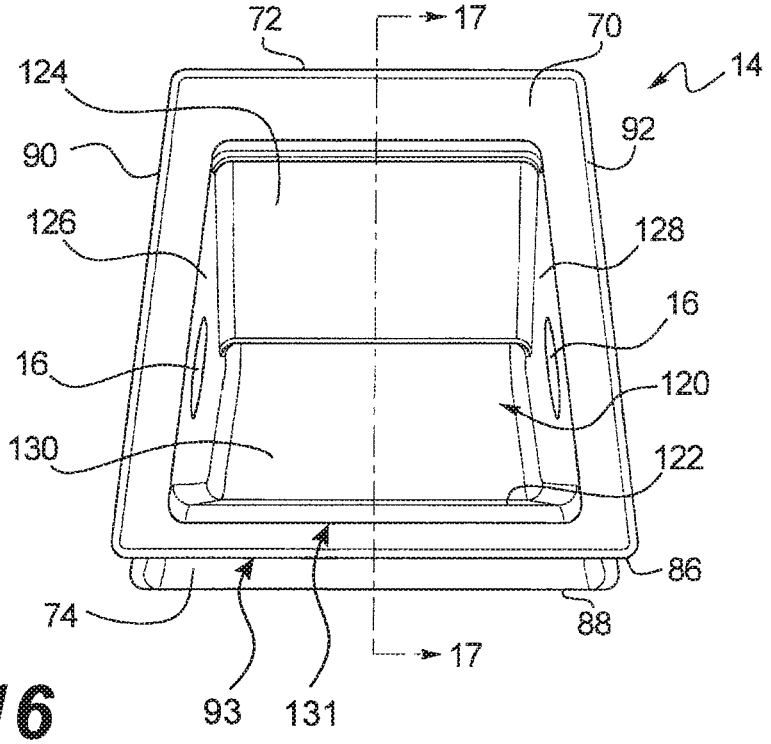
FIG. 16 is a rear view of the tip of FIG. 10 8.

Returning to FIG. 5, the intermediate portion 24 of the adapter 12 provides a transition between the straps 20, 22 and the nose 26 extending outwardly from the front end of the adapter 12. The nose 26 is configured to be received by a corresponding nose cavity 120 (FIG. 16) of the tip 14 as will be described more fully below. As shown in FIGS. 5 and 6, the nose 26 may have a bottom surface 42, a top surface 44, opposing side surfaces 46, 48, and a front surface 50. The bottom surface 42 may be generally planar and approximately parallel to the top surface 34 of the bottom strap 22 and, correspondingly, the bottom surface 36 of the implement 1, 6. Further, relative to a substantially longitudinal axis "A" defined by a major base edge 18 engaging surface of one of the straps 20, 22 of the adapter 12 such as the bottom surface 30 of the strap 20 or the top surface 34 of the bottom strap 22 as shown, the bottom surface 42 may be disposed lower on the adapter 12 than the top surface 34 of the bottom strap 22. Depending on the implementation, the bottom surface 42 may have a slight upward draft angle relative to the longitudinal axis "A" in the range of approximately 1°-3° to facilitate the removal of the adapter 12 from a mold or die in which the adapter 12 is fabricated, and the mating of the nose 26 within the nose cavity 120 (FIG. 16) of the tip 14.

The top surface 44 of the nose 26 may be configured to support the tip 14 during use of the implement 1, 6, and to facilitate retention of the tip 14 on the nose 26 when bearing the load of the work material. The top surface 44 may include a first support surface 52 disposed proximate the front surface 50, an intermediate sloped surface 54 extending rearwardly from the first support surface 52 toward the intermediate portion 24, and the second support surface 56 located between the intermediate surface 54 and the intersection with the intermediate portion 24 of the adapter 12. Each of the surfaces 52, 54, 56 may have a generally planar configuration, but may be oriented at angles with respect to each other. In the illustrated embodiment, the first support surface 52 may be approximately parallel to the bottom surface 42, and may have a slight draft angle to facilitate removal from a mold or die. The second support surface 56 may also be oriented approximately parallel to the bottom surface 42 and the first support surface 52. Further, relative to the longitudinal axis A, the second support surface 56 may be disposed at a higher elevation on the adapter 12 than the first support surface 52. The intermediate surface 54 extends between a rear edge 52*a* of the first support surface 52 and a transition area 56*a* of the second support surface 56, with the distance between the intermediate surface 54 and the bottom surface 42 increasing as the intermediate surface 54 approaches the second support surface 56. In one embodiment, the intermediate surface 54 may be oriented at an angle $\alpha$ of approximately 30° with respect to the bottom surface 42 of the nose 26, the top surface 34 of the bottom strap 22, and the first and second support surfaces 52, 56. The slope of the intermediate surface 54 facilitates insertion of the nose 26 into the cavity of the tip 14, while the broad, flat intermediate surface 54 limits the twisting of the tip 14 once the tip 14 is installed on the nose 26. The first and second support surfaces 52, 56 also assist in maintaining the orientation of the tip 14 on the adapter 12 as will be discussed more fully below.

The side surfaces 46, 48 of the nose 26 may be generally planar and extend upwardly between the bottom surface 42 and the top surface 44. A cylindrical surface 58 substantially coaxially oriented along an axis "B". The axis "B" is approximately perpendicular to the longitudinal axis "A". The cylindrical surface 58 may extend through the nose 26 and the side surfaces 46, 48 for receipt of a retention mechanism (not shown) for holding the tip 14 on the nose 26. The cylindrical surface 58 may be positioned to align with the retention apertures 16 (FIG. 3) of the tip 14. The side surfaces 46, 48 may be approximately parallel or angled inwardly at a longitudinal taper angle "LTA" of approximately 3° with respect to a line parallel to the longitudinal axis "A" (shown in FIG. 7 with respect to a line parallel to the axis "A" for clarity) as they extend forward from the intermediate portion 24 toward the front surface 50 of the nose 26 so that the nose 26 is tapered as shown in FIGS. 7 and 8. As best seen in the cross-sectional view of FIG. 9, the side surfaces 46, 48 may be angled so that the distance between the side surfaces 46, 48 decreases substantially symmetrically at vertical taper angle "VTA" of approximately 6° with respect to parallel vertical lines "VL" oriented perpendicular to the axes "A" and "B" as the side surfaces 46, 48 extend upwardly from the bottom surface 42 toward the top surface 44. Configured in this way, the nose 26 may have a substantially reverse or inverted keystone-shaped contour 62 defined by the bottom surface 42, top surface 44 and side surfaces 44, 46 wherein the nose 26 has a greater amount of wear material proximate the bottom surface 42 than proximate the top surface 44. The substantially reverse keystone-shaped contour 62 may be complementary to the contours 93, 131 (FIG. 16) of the tip 14 which may provide additional wear material at the bottom of the tooth assembly 10 where a greater amount of abrasion occurs in bottom-wearing applications.

The front surface 50 of the nose 26 may be planar as shown in FIG. 6, or may include a degree of curvature. As shown in the illustrated embodiment, the front surface 50 may be generally planar, and may be angled away from the intermediate portion 24 as it extends upwardly from the bottom surface 42. In one embodiment, the front surface 50 may extend forward at an angle $\gamma$ of approximately 15° with respect to a line 50*a* perpendicular to the bottom surface 42 or top surface 34 of the bottom strap 22. With the front surface 50 angled as shown, a reference line 60 extending inwardly approximately perpendicular to the front surface 50 and substantially bisecting the cylindrical surface 58 would create angles $\beta_1$, $\beta_2$, each measuring approximately 15°, between the bottom surface 42 and the reference line 60, and also between the intermediate surface 54 or the top surface 44 and the reference line 60. The reference line 60 may also approximately pass through a point of intersection 60*a* of lines 60*b*, 60*c* that are extensions of the bottom surface 42 and intermediate surface 54, respectively. Using the bottom surface 42 as a base reference, the reference line 60 is oriented at angle $\beta_1$ with respect to the bottom surface 42 and bisects the cylindrical surface 58, the intermediate surface is oriented at angle $\beta_2$ with respect to the reference line 60, and the front surface 50 is approximately perpendicular to the reference line 60. In alternate embodiments, the angle $\beta_1$ may be approximately 16° to provide approximately 1° of draft angle to facilitate removal from a mold or die during fabrication. Similarly, the angle $\alpha$ may be approximately 29° to provide approximately 1° of draft angle.

General Duty Tip for Bottom-Wearing Applications (FIGS. 10-17)

Figure 10:
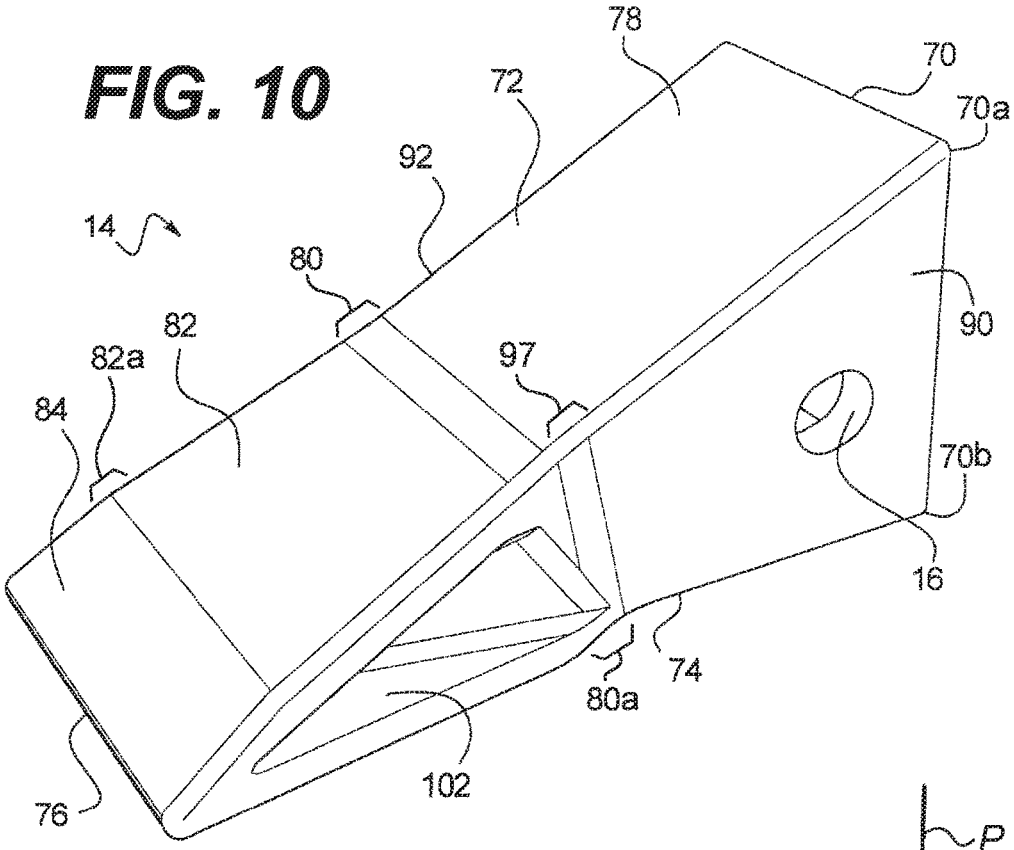
FIG. 10 is an isometric view of a tip of the tooth assembly of FIG. 3.
Figure 11:
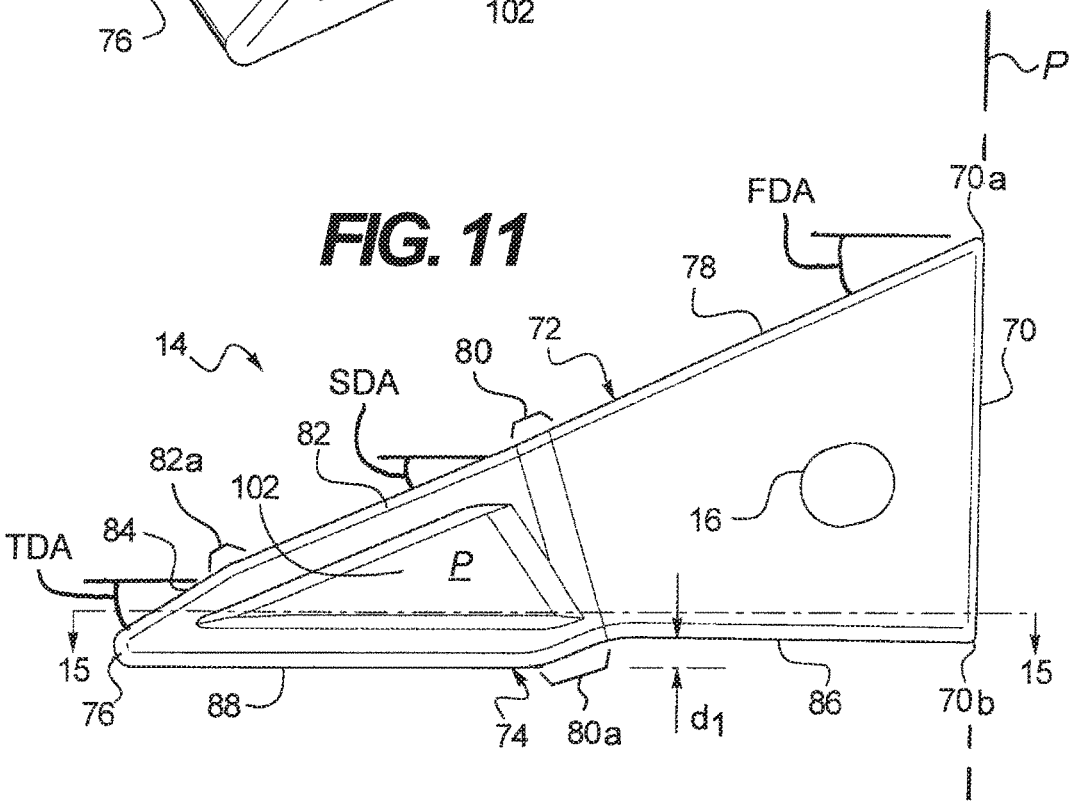
FIG. 11 is a side view of the tip of FIG. 10.

The tip 14 of the tooth assembly 10 is shown in greater detail in FIGS. 10-17. Referring to FIGS. 10 and 11, the tip 14 may be generally wedge-shaped, and may include a rear edge 70 having a top outer surface 72 extending forward from a top edge 70*a* of the rear edge 70, and a bottom outer surface 74 extending forward from a bottom edge 70*b* of the rear edge 70. The top outer surface 72 may be angled downwardly, and the bottom outer surface 74 may extend generally perpendicular to the rear edge 70 such that the top outer surface 72 and the bottom outer surface 74 converge at a front edge 76 at the front of the tip 14. The top outer surface 72 may present a generally planar surface of the tip 14, but may have distinct portions that may be slightly angled with respect to each other. Consequently, the top outer surface 72 may include a rear portion 78 extending from the rear edge 70 to an first top transition area 80 at a first downward angle "FDA" of approximately 29° with respect to a line perpendicular to a plane "P" defined by the rear edge 70, a front portion 82 extending forward from the transition area 80 at a second downward angle "SDA" of approximately 25° with respect to a line perpendicular to the plane "P", and a tip portion 84 extending from a second top transition area 82*a* between the front portion 82 and the tip portion 84 at a third downward angle "TDA" of approximately 27° relative to a line perpendicular to the plane "P". The generally planar configuration of the top outer surface 72 may allow the work material to slide up the top outer surface 72 and toward the base edge 18 of the implement 1, 6 when the front edge 76 digs into a pile of work material with less resistance to the forward motion of the implement 1, 6 than may be provided if the tooth assembly had a top outer surface with a greater amount of curvature or with one or more recesses redirecting the flow of the work material.

The bottom outer surface 74 may also be generally planar but with an intermediate elevation change at a bottom transition area 80*a* of the transition area 80 on the bottom outer surface 74. Consequently, a rear portion 86 of the bottom outer surface 74 may extend the rear edge 70 is approximately perpendicular relation to the transition area 80*a* until the bottom outer surface 74 transitions to a lower front portion 88. The front portion 88 may also be oriented approximately perpendicular to the rear edge 70, and may extend to the front edge 76 at an elevation below the rear portion 86 by a distance $d_1$. When the tooth assembly 10 digs into the work material, a majority of the abrasion between the tip 14 and the work material occurs at the front edge 76, the tip portion 84 of the top outer surface 72, and the front portion 88 of the bottom outer surface 74 of the tip 14. By lowering the front portion 88 of the bottom outer surface 74, additional wear material is provided at the high abrasion area to extend the useful life of the tooth assembly 10.

The tip 14 also includes lateral outer surfaces 90, 92 extending between the top outer surface 72 and the bottom outer surface 74 on either side of the tip 14. Each of the lateral outer surfaces 90, 92 may have a corresponding one of the retention apertures 16 extending therethrough in a location between the rear portions 78, 86. As best seen in the top view of FIG. 12, the bottom view of FIG. 13, and the front view of FIG. 14, the lateral outer surfaces 90, 92 may be angled so that the distance between the lateral outer surfaces 90, 92 decreases as the lateral outer surfaces 90, 92 extend upwardly from the bottom outer surface 74 toward the top outer surface 72. Configured in this way, the tip 14 may have a substantially inverted or reversed keystone-shaped contour 93 (FIG. 14) defined by the top outer surface 72, the bottom outer surface 74 and the lateral outer surfaces 90, 92 and corresponding to the substantially reverse or inverted keystone-shaped contour 62 described above for the nose 26. As with the lowering of the front portion 88 of the bottom outer surface 74, the tip 14 is provided with a greater amount of wear material proximate the bottom outer surface 74 where a greater amount of abrasion occurs, and a lesser amount of wear material proximate the top outer surface 72 where less abrasion occurs in bottom-wearing applications. In this configuration, the amount of wear material, and correspondingly the weight and cost of the tip 14, may be reduced or at least be more efficiently distributed, without reducing the useful life of the tooth assembly 10.

Figure 12:
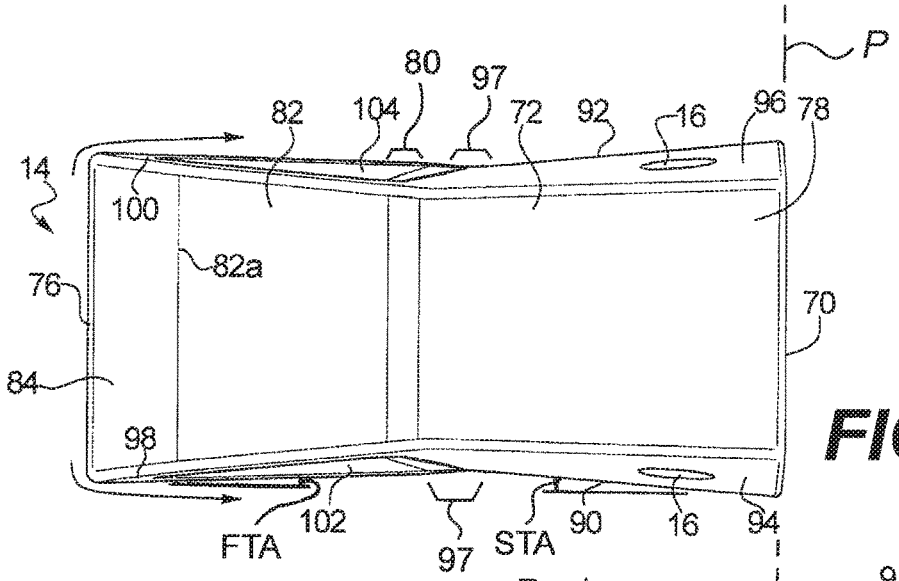
FIG. 12 is a top view of the tip of FIG. 10.
Figure 13:
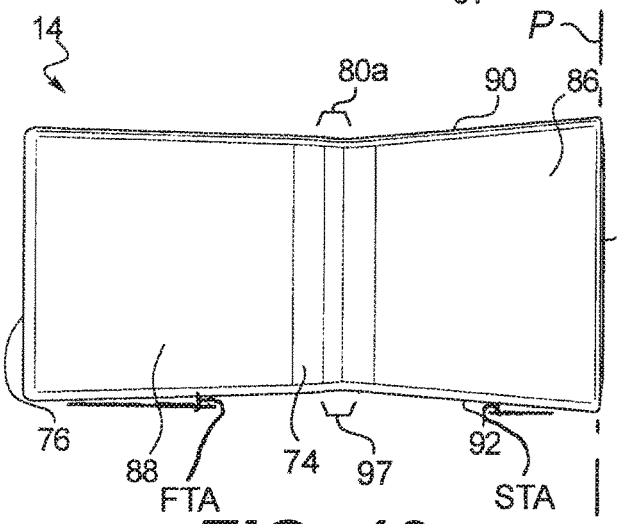
FIG. 13 is a bottom view of the tip of FIG. 10.
Figure 14:
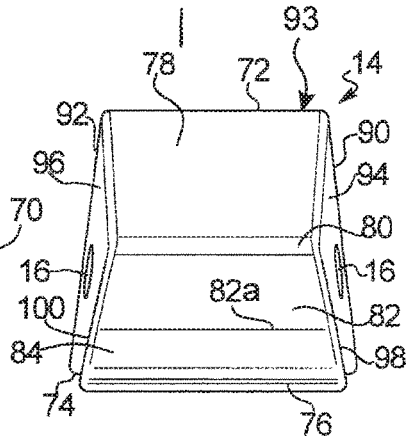
FIG. 14 is a front view of the tip of FIG. 10.

FIGS. 12-14 further illustrate that the tip 14 may be configured with a shape approximating an hourglass. The lateral outer surfaces 90, 92 may have rear portions 94, 96 extending forward from the rear edge 70 and oriented such that the distance between the rear portions 94, 96 decreases as the rear portions 94, 96 approach a side transition area 97 with a side taper angle "STA" of approximately 3° with respect to a line perpendicular to the plane "P". It should be noted that the side taper angle "STA" is approximately equal to the longitudinal taper angle "LTA" of the nose 26 of the adapter 12. Beyond the transition area 97, the lateral outer surfaces 90, 92 transition to front portions 98, 100 that may be parallel or diverge as the front portions 98, 100 progress forward to a maximum width proximate the front edge 76 at a front taper angle "FTA" that may be greater than 0° with respect to a line perpendicular to the plane "P". The tapering of the front portions 98, 100 of the lateral outer surfaces 90, 92 behind the front edge 76 as shown in the embodiment in FIGS. 12 and 13 may reduce the amount of drag experienced by the tip 14 as it passes through the work material. As the front edge 76 digs into the work material, the work material on the sides flows outwardly and around the tip 14 as indicated by the arrows in FIG. 12, with less engagement of the lateral outer surfaces 90, 92 than if the front portions 98, 100 were parallel and maintained a constant width as they extend rearwardly from the front edge 76.

Figure 15:
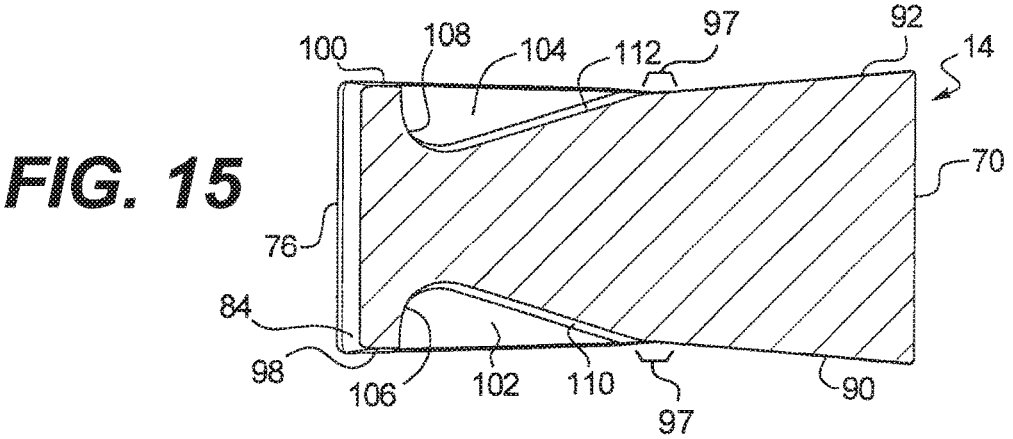
FIG. 15 is a cross-sectional view of the tip of FIG. 10 taken through line 15-15 of FIG. 11.

Returning to FIGS. 10-12, the front portions 98, 100 of the lateral outer surfaces 90, 92, respectively, may include reliefs 102, 104. The reliefs 102, 104 may extend inwardly from the lateral outer surfaces 90, 92 into the body of the tip 14 to define pockets "P" in the tip 14. The cross-sectional view of FIG. 15 illustrates the geometric configuration of one embodiment of the reliefs 102, 104. The reliefs 102, 104 may include forward curved portions 106, 108 extending inwardly into the body of the tip 14 at the front portions 98, 100 of the respective lateral outer surfaces 90, 92. As the curved portions 106, 108 extend inwardly, the reliefs 102, 104 may turn rearwardly toward the rear edge 70 and transition into rearward tapered portions 110, 112. The tapered portions 110, 112 may diverge from one another as they extend rearwardly toward the rear edge 70, and ultimately terminate with the corresponding front portions 98, 100 of the lateral outer surfaces 90, 92 proximate the transition area 97. The illustrated configuration of the relief's 102, 104 reduces the weight of the tip 14, reduces resistance of the movement of the tip 14 through the work material, and provides a self-sharpening feature to the tip 14 as will be described more fully below. However, alternative configurations for the reliefs 102, 104 providing benefits to the tip 14 will be apparent to those skilled in the art and are contemplated by the inventors is having used in tooth assemblies 10 in accordance with the present disclosure.

The tip 14 may be configured to be received onto the nose 26 of the adapter 12. In the rear view of the tip 14 in FIG. 16, a nose cavity 120 may be defined within the tip 14 by a surface extending inwardly from the rear edge 70. The nose cavity 120 may have a complementary configuration relative to the nose 26 of the adapter 12, and may include a bottom inner surface 122, a top inner surface 124, a pair of opposing side inner surfaces 126, 128, and a front inner surface 130. As seen from behind, the nose cavity 120 may have a substantially inverted keystone-shaped contour 131 in a manner complementary to the contour 93 of the exterior of the tip 14 and the contour 72 of the nose of the adapter 12. The distances between the top outer surface 72 and top inner surface 124, and between the bottom outer surface 74 and bottom inner surface 122, may be constant in the lateral direction across the tip 14. The side inner surfaces 126, 128 may be angled inwardly so that the distance between the side inner surfaces 126, 128 decreases as the side inner surfaces 126, 128 extend vertically from the bottom inner surface 122 toward the top inner surface 124. Oriented in this way, the side inner surfaces 126, 128 mirror the lateral outer surfaces 90, 92 and a constant thickness is maintained between the side inner surfaces 126, 128 of the nose cavity 120 and the lateral outer surfaces 90, 92, respectively, on the exterior of the tip 14.

Figure 17:
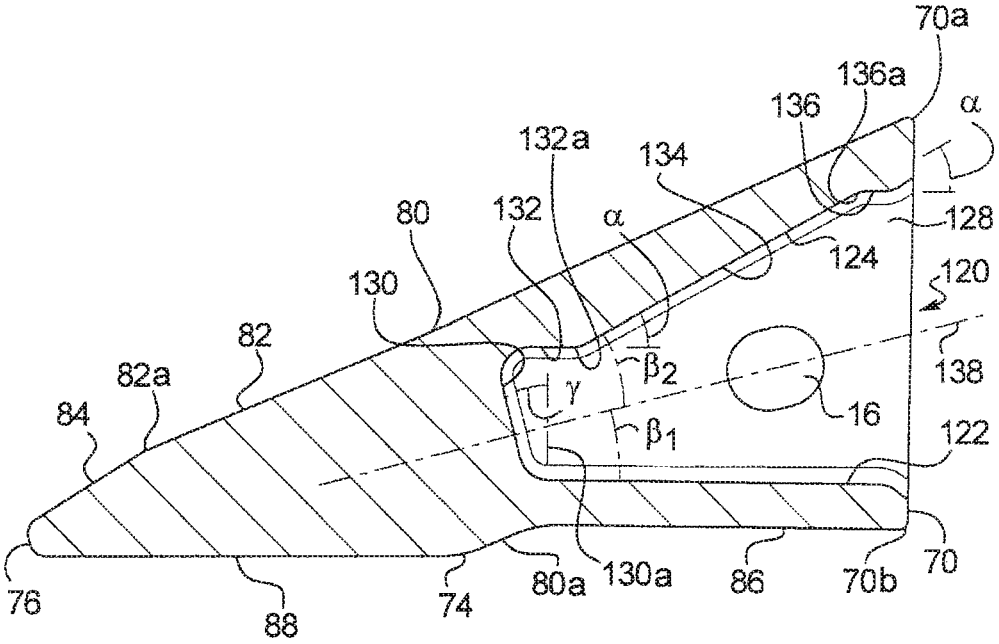
FIG. 17 is a cross-sectional view of the tip of FIG. 10 taken through line 17-17 of FIG. 16.
Figure 18:
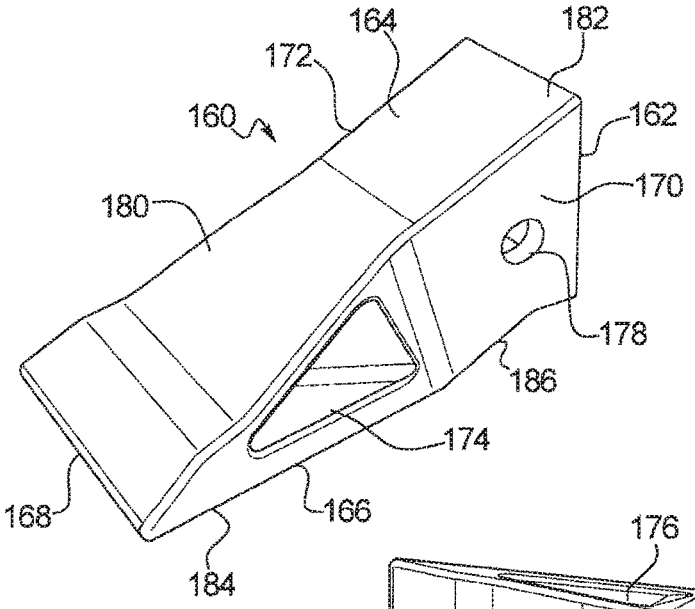
FIG. 18 is an isometric view of an alternative embodiment of a tip for a tooth assembly in accordance with the present disclosure.
Figure 19:
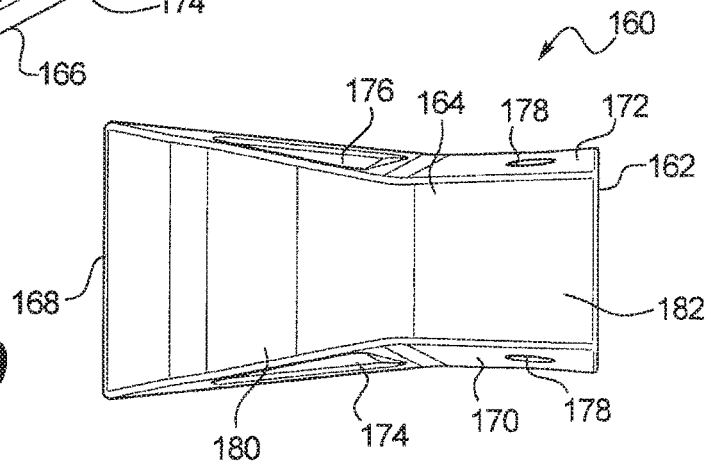
FIG. 19 is a top view of the tip of FIG. 18.
Figure 20:
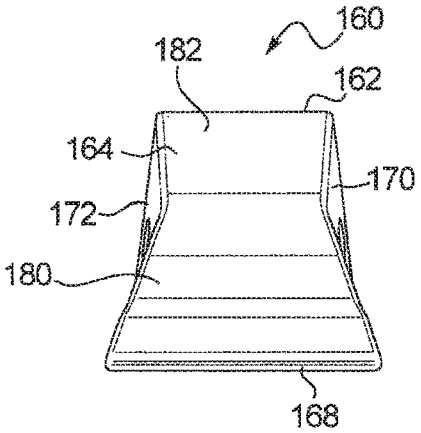
FIG. 20 is a front side view of the tip of FIG. 18.

The cross-sectional view of FIG. 17 illustrates the correspondence between the nose cavity 120 of the tip 14 and the nose 26 of the adapter 12. The bottom inner surface 122 may be generally planar and approximately perpendicular to the rear edge 70. The bottom inner surface 122 may also be generally parallel to the rear portion 86 and front portion 88 of the bottom outer surface 74. If the bottom surface 42 of the adapter 12 has an upward draft angle, the bottom inner surface 122 of the tip 14 may have a corresponding upward slope to match the draft angle.

The top inner surface 124 may be shaped to mate with the top surface 44 of the nose 26, and may include a first support portion 132, a sloped intermediate portion 134, and a second support portion 136. The first and second support portions 132, 136 may be generally planar and approximately parallel to the bottom inner surface 122, but may have a slight downward slope corresponding to the orientation that may be provided in the first and second support surfaces 52, 56 of the top surface 44 of the nose 26 to facilitate removal from a mold or die. The intermediate portion 134 of the top inner surface 124 may extend between a rear edge 132*a* of the first support portion 132 and a transition area 136*a* of the second support portion 136, with the distance between the intermediate portion 134 and the bottom inner surface 122 increasing in a similar manner as between the intermediate surface 54 and the bottom surface 42 of the nose 26. Consistent with the relationship between the bottom surface 42 and intermediate surface 54, the intermediate portion 134 may be oriented at an angle $\alpha$ of approximately 30° with respect to the bottom inner surface 122 and the first and second support portions 132, 136.

The front inner surface 130 of the nose cavity 120 has a shape corresponding to the front surface 50 of the nose 26, and may be planar as shown or have the necessary shape to be complementary to the shape of the front surface 50. As shown in FIG. 17, the front inner surface 130 may be angled toward the front edge 76 at an angle $\gamma$ of approximately 15° with respect to a line 130*a* perpendicular to the bottom inner surface 122. A reference line 138 may extend inwardly substantially perpendicular to the front inner surface 130 and substantially bisect the retention aperture 16. To match the shape of the nose cavity 120, the reference line 138 may be oriented at an angle $\theta$1 of approximately 15° with respect to the bottom inner surface 122 of the nose cavity 120, and at an angle $\theta$2 of approximately 15° with respect to the intermediate portion 134 of the top inner surface 124. The shapes of the nose 26 and nose cavity 120 are exemplary of one embodiment of the tooth assembly 10 in accordance with the present disclosure. Those skilled in the art will understand that variations in the relative angles and distances between the various surfaces of the nose 26 and nose cavity 120 may be varied from the illustrated embodiment while still producing a nose and nose cavity having complementary shapes, and such variations are contemplated by the inventor as having use in tooth assemblies 10 in accordance with the present disclosure.

Abrasion Tip for Bottom-Wearing Applications (FIGS. 18-21)

Figure 21:
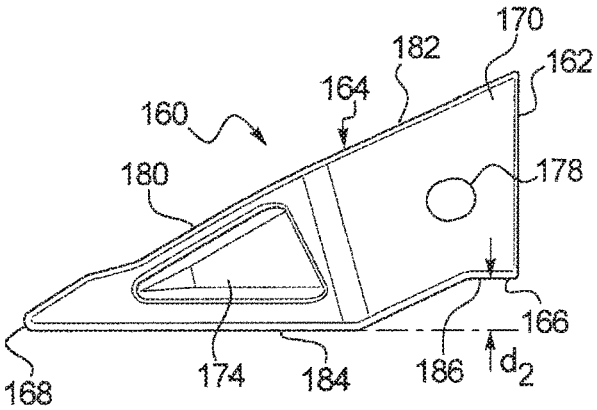
FIG. 21 is a left side view of the tip of FIG. 18.
Figure 22:
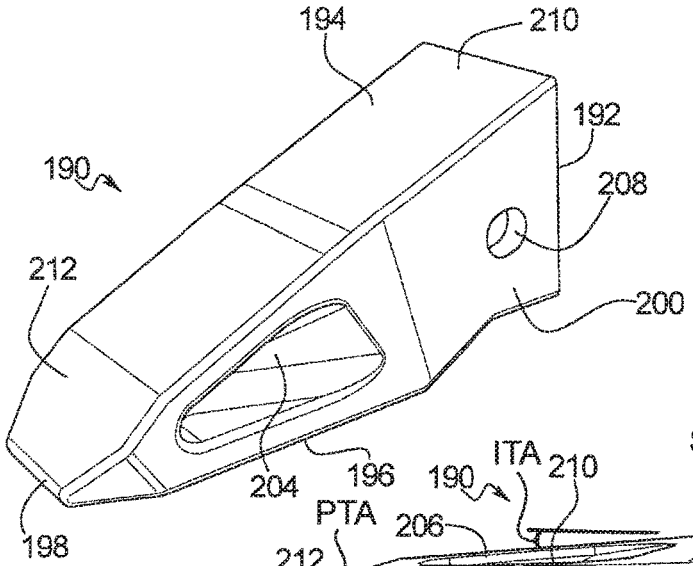
FIG. 22 is an isometric view of a further alternate embodiment of a tip for a tooth assembly in accordance with the present disclosure.
Figure 23:
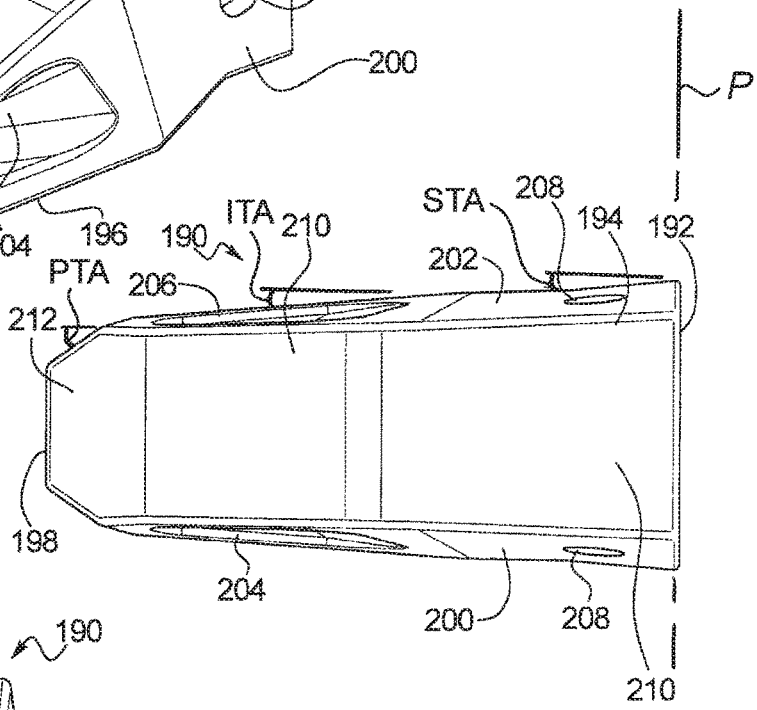
FIG. 23 is a top view of the tip of FIG. 22.
Figure 24:
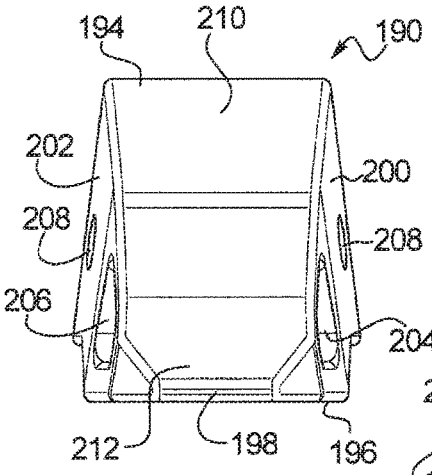
FIG. 24 is a front view of the tip of FIG. 22.
Figure 25:
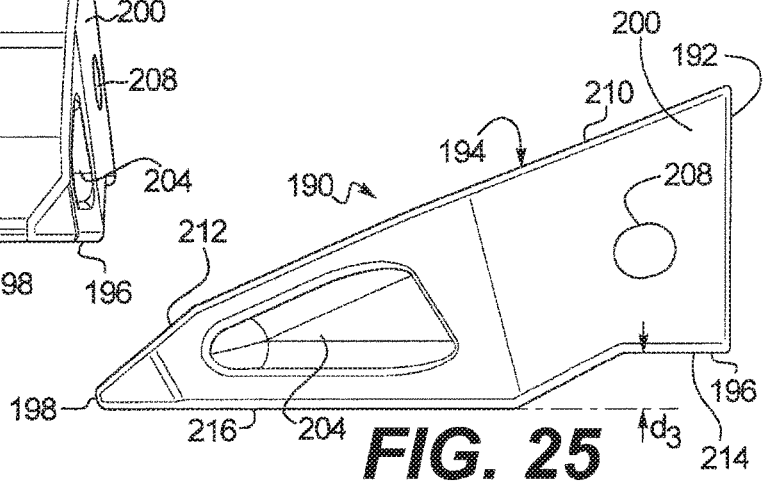
FIG. 25 is a left side view of the tip of FIG. 22

Depending on the particular environment in which the tooth assemblies 10 are being used, the tip 14 of the tooth assembly 10 as illustrated and described above with respect to FIGS. 1-17 may be modified as necessary. For example, where the machine may be operating on work materials that are highly abrasive and may wear down tips at a much greater rate, it may be desirable to provide more wear material at the front of the tip. FIGS. 18-21 illustrate one embodiment of a tip 160 having use in loading abrasive work materials. The tip 160 may have the same general configuration as discussed above for the tip 14, and may include a rear edge 162, a top outer surface 164, and a bottom outer surface 166, with the top and bottom outer surfaces 164, 166 extending forward from the rear edge 162 and converging to a front edge 168. Lateral outer surfaces 170, 172 may include reliefs 174, 176, respectively, and retention apertures 178 as described above. The top outer surface 164 may have a front portion 180 and a rear portion 182, with the bottom outer surface 166 having a front portion 184 and a rear portion 186. To compensate for the greater abrasion experienced by the tip 160, the front portion. 180 of the top outer surface 164 may be provided with additional wear material and may be wider with respect to the rear portion 182 than the width of the front portion 82 of the tip 14 relative to the rear portion 78. The front portion 180 may be generally rectangular, or may be slightly tapered as the front portion 180 proceeds rearward from the front edge 168. Further, as shown in FIG. 21, additional wear material may be provided to the bottom outer surface 166 by lowering the front portion 184 to a distance $d_2$ below the rear portion 186 that may be greater than the distance $d_1$ between the front portion 88 and rear portion 86 of the bottom outer surface 74 of the tip 14. The distance $d_2$ may be approximately two to three times greater than the distance $d_1$. The additional wear material at the front portions 180, 184 of the tip 160 may extend the useful life of the tip 160 when used in particularly abrasive environments.

Penetration Tip for Bottom-Wearing Applications (FIGS. 22-25)

Where the tooth assemblies 10 are being used in rocky environments where a greater ability to penetrate the work material may be required, it may be required to provide the tip having a sharper penetration end for breaking up the work material. Referring to FIGS. 22-25, a penetration tip 190 is illustrated and may include a rear edge 192, a top outer surface 194 and a bottom outer surface 196, with the top outer surface 194 and bottom outer surface 196 extending forward from the rear edge 192 and converging to a front edge 198. Lateral outer surfaces 200, 202 may include reliefs 204, 206, respectively, and retention apertures 208 as described above. The top outer surface 194 may have a rear portion 210 and a front portion 212, and the bottom outer surface 196 having a rear portion 214 and a front portion 216. The rear portion 210 may extend forward from the rear edge 192 with the lateral outer surfaces 200, 202 being approximately parallel of slightly tapered at a side taper angle "STA" of approximately 3' to match the taper of the nose 26 of the adapter 12 and converging as the lateral outer surfaces 200, 202 extend from the rear edge 192. As the rear portion 210 approaches the front edge 198, the top outer surface 194 may transition into the front portion 212, with the lateral outer surfaces 200, 202 having a greater taper such that the lateral outer surfaces 200, 202 may transition into front portions that may initially be approximately parallel or have an intermediate taper angle "ITA" and then further transition as the front portions approach the front edge 76 to have a greater taper at a penetration taper angle "PTA" of at least 10° with respect to a line perpendicular to the plane "P" to converge at a greater rate than the convergence within the rear portion 210. Consequently, the front edge 198 may be narrower in relation to the general width of the penetration tip 190 than in the other embodiments of the tip 14, 160. The narrow front edge 198 may provide a smaller surface area for engaging the rocky work material, but increase the force per unit of contact area applied to the rocky work material by the series of tooth assemblies 10 attached at the base edge 18 of the implement 1, 6 to break up the rocky work material. While wear material may be removed from the penetration tip 190 by narrowing the front edge 198, additional wear material still may be provided to the bottom outer surface 196 by lowering the front portion 216 to a distance $d_3$ below the rear portion 214 that may be greater than the distance $d_1$ between the front portion 88 and rear portion 86 of the bottom outer surface 74 of the tip 14. As with the distance $d_2$ of the tip 160, the distance $d_3$ may be approximately two to three times greater than the distance $d_1$.

INDUSTRIAL APPLICABILITY

Tooth assemblies 10 in accordance with the present disclosure incorporate features that may extend the useful life of the tooth assemblies 10 and improve the efficiency of the tooth assemblies 10 in penetrating into the work material. As discussed above, the substantially inverted keystone-shaped contour 93 of the tip 14, for example, places a greater amount of wear material towards the bottom of the tip 14 where a greater amount of abrasion occurs in bottom-wearing applications. At the same time, wear material is removed from the upper portion of the tip 14 where less abrasion occurs, thereby reducing the weight and the cost of the tip 14. The distribution of wear material on the adapter 12 similarly places additional wear material in the bottom strap 22 where more wear takes place, and less wear material in the top strap 20 that is subjected to a relatively lesser amount of abrasion, though in some implementations the top strap 20 may need to be thicker than dictated by abrasion to provided sufficient strength and prevent breakage due to the loading forces.

Figure 26:
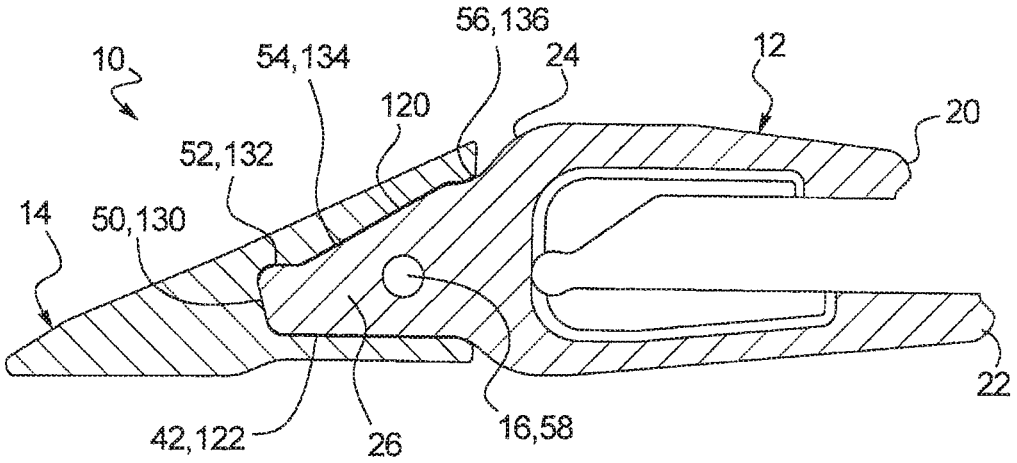
FIG. 26 is a cross-sectional view of the tooth assembly of FIG. 3 taken through line 26-26 with the tip as shown in FIG. 17 installed on the adapter of FIG. 6.

The design of the tooth assemblies 10 in accordance with the present disclosure may also reduce the stresses applied to the retention mechanism connecting the tip 14 to the adapter 12. Using the adapter 12 and tip 14 for illustration in FIGS. 26 and 27, based on the machining tolerances required in the retention apertures 16, the cylindrical surface 58 and the corresponding components of a retention mechanism (not shown), the tip 14 may experience movement relative to the adapter 12, and in particular to the nose 26, during use of the machine. The relative movement may cause shear stresses in the components of the retention mechanism as the adapter 12 and the tip 14 move in opposite directions. In prior tooth assemblies where a nose of an adapter may have a truncated triangular shape when viewed from the side, or may have a more rounded shapes than the substantially inverted keystone-shaped contour 62 of the nose 26, facing surfaces of the nose of the adapter and the nose cavity of the tip may separate and allow the tip to rotate about a longitudinal axis of the tooth assembly relative to the adapter. The twisting of the tip may cause additional shear stresses on the components of the retention mechanism.

In contrast, in the tooth assemblies 10 in accordance with the present disclosure, the support surfaces 52, 56 of the adapter nose 26 may be engaged by the corresponding support portions 132, 136 that define the nose cavity 120. As shown in the cross-sectional view of FIG. 26, when the tip 14 is installed on the adapter nose 26 and disposed at a maximum engagement position, the planar surfaces of the nose 26 are engaged by the corresponding planar portions of the surfaces that define the nose cavity 120 of the tip 14. Consequently, the bottom surface 42 of the adapter 12 may face and engage the bottom inner surface 122 of the tip 14, the support surfaces 52, 54, 56 of the top surface 44 of the adapter 12 may face and engage the corresponding portions 132, 134, 136 of the top inner surface 124 of the tip 14 and the front surface 50 of the adapter 12 may face and engage the front inner surface 130 of the tip 14. Though not shown, the side surfaces 46, 48 of the nose 26 of the adapter 12 may face and engage the side inner surfaces 126, 128, respectively, of the nose cavity 120 of the tip 14. With the surfaces engaging, the tip 14 may remain relatively stationary with respect to the nose 26 of the adapter 12.

Figure 27:
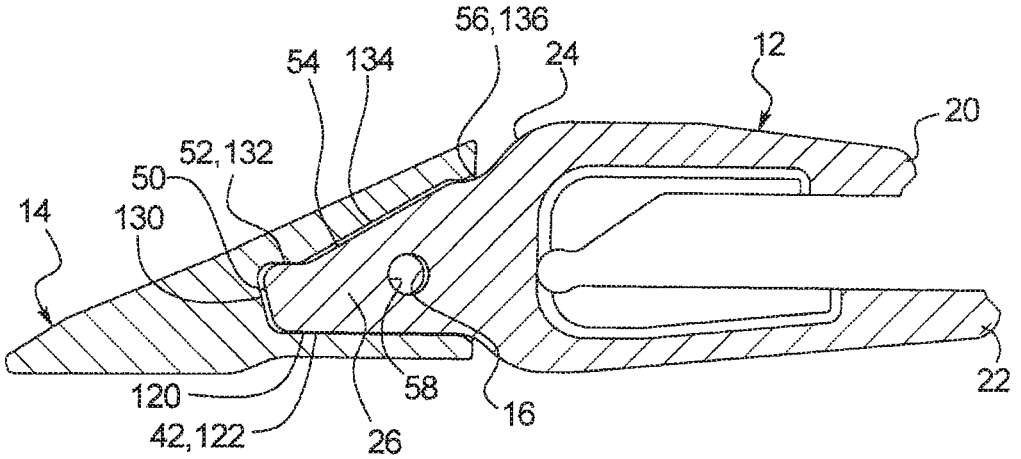
FIG. 27 is the cross-sectional view of the tooth assembly of FIG. 26 with the tip moved forward due to tolerances within a retention mechanism.

Due to the tolerances within the retention mechanism, the tip 14 may be able to slide forward on the nose 26 of the adapter 12 is illustrated in FIG. 27. As the tip 14 slides forward, some of the facing surfaces of the nose 26 and the nose cavity 120 may separate and disengage. For example, the intermediate portion 134 of the top inner surface 124 of the tip 14 may disengage from the intermediate surface 54 of the nose 26 of the adapter 12, and the front inner surface 130 of the tip 14 may disengage from the front surface 50 of the adapter 12. Because the distance between the side surfaces 46, 48 of the nose 26 of the adapter 12 may narrow as the nose 26 extends outwardly from the intermediate portion 24 of the adapter 12 as shown in FIGS. 7 and 8, the side inner surfaces 126, 128 of the tip 14 may separate from the side surfaces 46, 48, respectively. Despite the separation of some surfaces, engagement between the nose 26 of the adapter 12 and nose cavity 120 of the tip 14 may be maintained over the range of movement of the tip 14 caused by the tolerances within the retention mechanism. As discussed previously, the bottom surface 42 and support surfaces 52, 56 of the nose 26 of the adapter 12, and the bottom inner surface 122 and support portions 132, 136 of the top inner surface 124 of the tip 14, may be generally parallel. Consequently, the tip 14 may have a direction of motion substantially parallel to, for example, the bottom surface 42 of the nose 26 of the adapter 12, with the bottom surface 42 maintaining contact with the bottom inner surface 122 of the nose cavity 120 of the tip 14, and the support portions 132, 136 of the top inner surface 124 of the tip 14 maintaining contact with the support surfaces 52, 56 of the adapter 12, respectively. With the planar surfaces remaining in contact, the tip 14 may be constrained from substantial rotation relative to the nose 26 that may otherwise cause additional shear stresses on the retention mechanism components. Even where draft angles may be provided in the bottom surface 42, the bottom inner surface 122, the support surfaces 52, 56 and the support portions 132, 136, and a slight separation may occur between the facing surfaces, the rotation of the tip 14 may be limited to an amount less than that at which shear stresses may be applied to the components of the retention mechanism. By reducing the shear stresses applied to the retention mechanism, it is anticipated that the rate of failure of the retention mechanisms, and correspondingly the instances of the breaking off of the tips 14 prior to the end of their useful lives, may be reduced.

Figure 28:
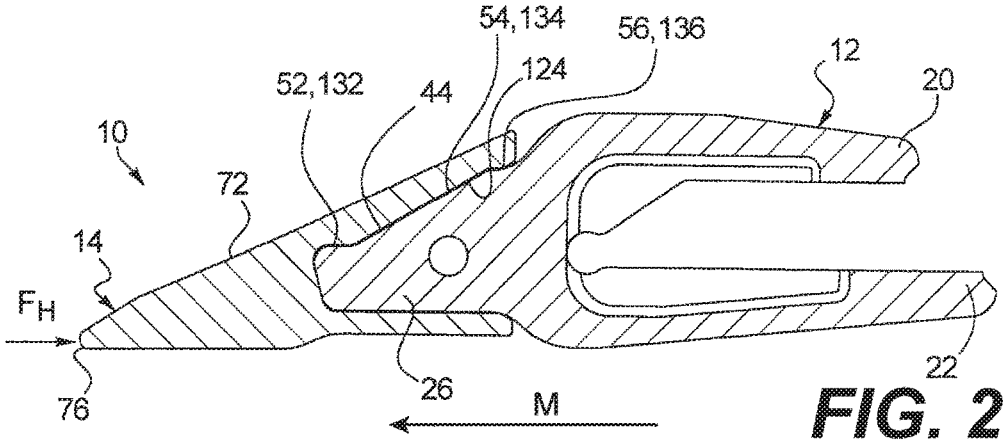
FIG. 28 is the cross-sectional view of the tooth assembly of FIG. 26 with the section lines removed and showing a force applied to the tooth assembly when an implement digs into a pile of work material.

The configuration of the tooth assemblies 10 according to the present disclosure may also facilitate a reduction in the shear stresses on the retention mechanisms when forces are applied that may otherwise tend to cause the tips 14, 180, 190 to slide off the nose 26 of the adapter 12. Because adapter noses known in the art typically have a generally triangular configuration and taper laterally as the noses extend forward from the straps, forces applied during use may generally influence the tips to slide off the front of the adapter noses. Such movement is resisted by the retention mechanism, thereby causing shear stresses. The adapter nose 26 of the adapter 12 in accordance with the present disclosure may at least in part counterbalance to forces tending to cause the tips 14, 180, 190 to slide off the adapter nose 26. FIG. 28 illustrates the tooth assembly 10 formed by the adapter 12 and the tip 14 with a generally horizontal orientation as may occur when the machine is being driven forward into a pile of work material as indicated by arrow "M". The adapter 12 and the tip 14 are used for illustration in FIGS. 28-30, but those skilled in the art will understand that the various combinations of the adapter 12 and the tips 14, 180, 190 would interact in a similar manner as described hereinafter. The work material may resist penetration of the tooth assembly 10 into the pile, resulting in the application of a horizontal force $F_H$ against the front edge 76. The force $F_H$ may push the tip 14 toward the adapter 12 and into tighter engagement with the nose 26 of the adapter 12 without increasing the shear stresses on the retention mechanism.

Figure 29:
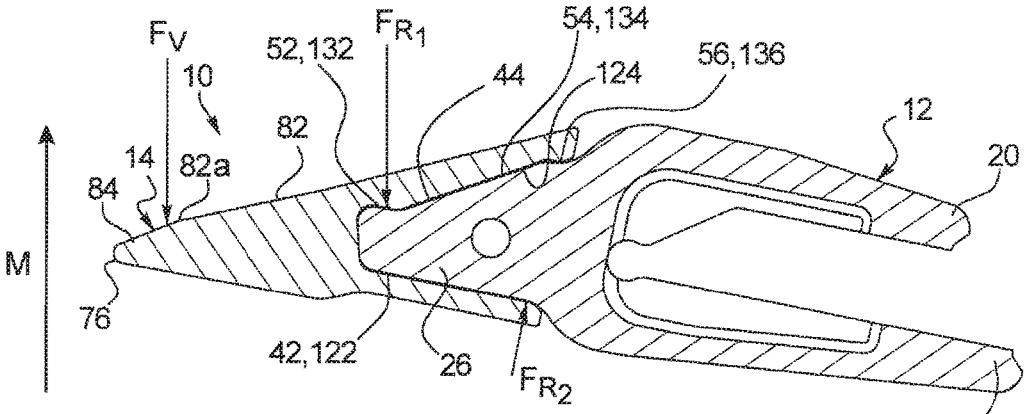
FIG. 29 is the cross-sectional view of the tooth assembly of FIG. 28 with the tooth assembly and the implement direct partially upward and showing forces applied to the tooth assembly when the implement is raised up through the pile of work material.

In FIG. 29, the tooth assembly 10 is illustrated in a position wherein the implement 1 may be partially racked upwardly as the machine begins to lift a load of work material out of the pile in the direction indicated by arrow "M". As the implement 1 is lifted out of the work material, a vertical force $F_V$ may be applied to the top outer surface 72 of the tip 14. The vertical force $F_V$ may be a resultant force acting on the front portion 82 and/or tip portion 84 of the tip 14 that may be a combination of the weight of the work material and resistance of the work material from being dislodged from the pile. The vertical force $F_V$ may be transmitted through the tip 14 to the adapter nose 26 and the top inner surface 124 of the nose cavity 120 of the tip 14 for support, and thereby yielding a first resultant force $F_{R1}$ on the front support surface 52 of the adapter nose 26. Because the line of action of the vertical force $F_V$ is located proximate the front edge 76, the vertical force $F_V$ tends to rotate the tip 14 in a counterclockwise direction as shown about the nose 26 of the adapter 12, with the first support surface 52 of the nose 26 acting as the fulcrum of the rotation. The moment created by the vertical force $F_V$ causes a second resultant force $F_{R2}$ acting on the bottom surface 42 of the adapter 12 proximate the intermediate portion 24 of the adapter 12.

Figure 30:
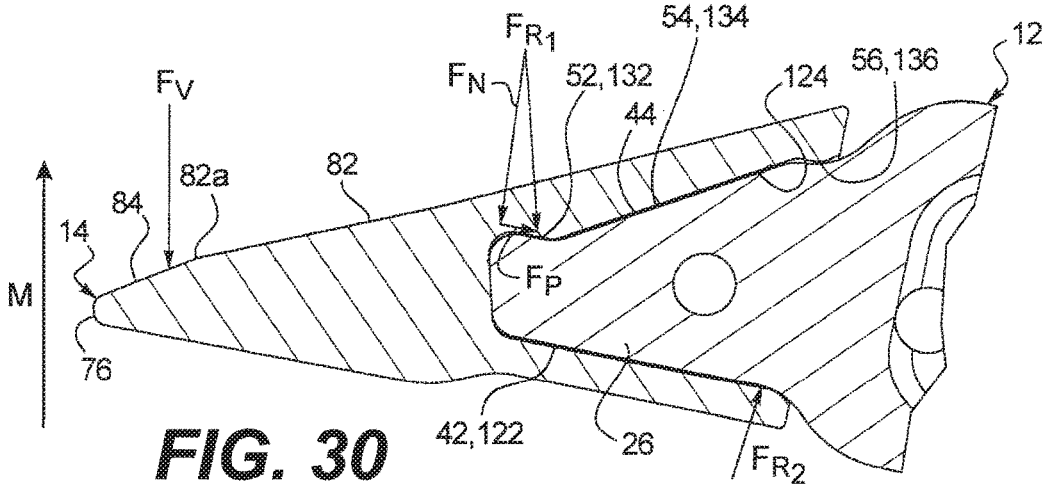
FIG. 30 is an enlarged view of the tooth assembly of FIG. 29 illustrating forces acting on the nose of the adapter and the nose cavity surfaces of the tip.

In previously known tip assemblies having continuously sloping top surfaces of the noses, the first resultant force $F_{R1}$ would tend to cause the tip to slide off the front of the nose, and thereby cause additional strain on the retention mechanism. In contrast, the orientation of the front support surface 52 of the adapter 12 with respect to the intermediate surface 54 of the adapter 12 causes the tip 14 to slide into engagement with the nose 26. FIG. 30 illustrates an enlarged portion of the adapter nose 26 and the tip 14, and shows the resultant forces tending to cause movement of the tip 14 relative to the adapter nose 26. The first resultant force $F_{R1}$ acting on the front support surface 52 of the adapter 12 and first support portion 132 of the tip 14 has a first normal component $F_N$ acting perpendicular to the front support surface 52, and a second component $F_P$ acting parallel to the front support surface 52 and the first support portion 132. Due to the orientation of the front support surface 52 of the adapter 12 and first support portion 132 of the tip 14 relative to the intermediate surface 54 of the adapter 12 and intermediate portion 134 of the tip 14, the parallel component $F_P$ of the first resultant force $F_{R1}$ tends to cause the tip 14 to slide rearward and into engagement with the nose 26 of the adapter 12. The parallel component $F_P$ tending to slide the tip 14 onto the nose 26 reduces the shear stresses applied on the components of the retention mechanism, and correspondingly reduces the incidence of failure of the retention mechanism.

Figure 31:
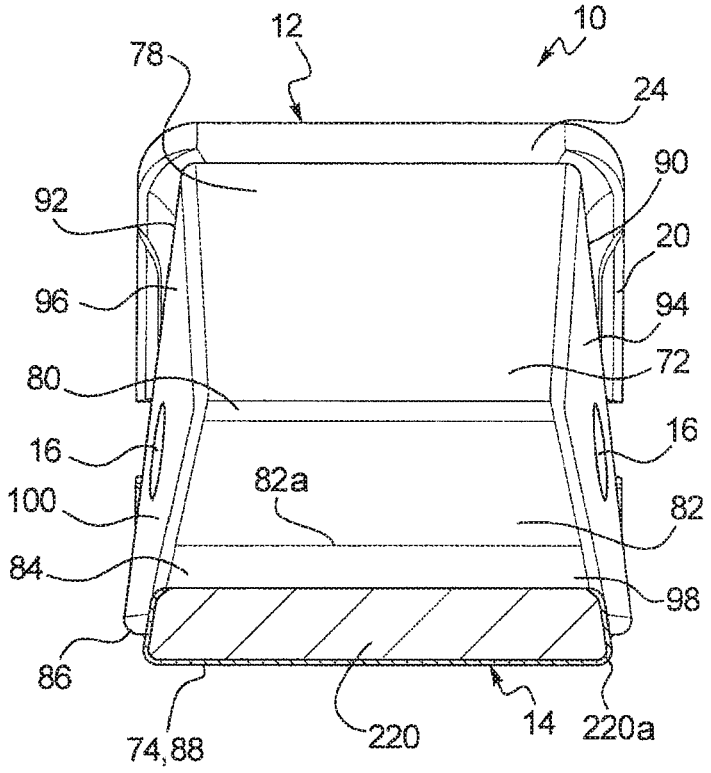
FIG. 31 is a cross-sectional view of the tooth assembly of FIG. 4 taken through line 31-31.

In addition to the retention benefits of the configuration of the nose 26 of the adapter 12 and the nose cavities 120 of the tips 14, 180, 190 as discussed above, the tooth assemblies 10 may provide benefits in during use in top-wearing and bottom-wearing applications. The geometric configuration of the tips 14, 180, 190 of the tooth assemblies 10 in accordance with the present disclosure may provide improved efficiency in penetrating work material in bottom-wearing applications over the useful life of the tips 14, 180, 190 as compared to tips previously known in the art. As wear material is worn away from the front of the tips 14, 180, 190, the reliefs 102, 104, 174, 176, 204, 206 may provide a self-sharpening feature to the tips 14, 180, 190 providing improved penetration where previously known tips may become blunted and shaped more like a first than a cutting tool. The front view of the tip 14 in FIG. 14 shows the front edge 76 forming a leading cutting surface that initially enters the work material. The cross-sectional views shown in FIGS. 31-36 illustrate changes in the geometry of the cutting surface as wear material wears away from the front of the tip 14. FIG. 31 shows a cross-sectional view of the tooth assembly 10 of FIG. 4 with the section taken between the front edge 76 and the reliefs 102, 104. After abrasion wears away the tip 14 to this point, a cutting surface 220 of the tip 14 now presents a cross-sectional area engaging the work material that is less sharp than the front edge 76 as the machine drives forward. It will be apparent to those skilled in the art that abrasion from engagement with the work material may cause the outer edges of the cutting surface 220 to become rounded, and for the front portion 88 of the bottom outer surface 74 to wear away as indicated by the cross-hatched area 220*a* and thereby reduce the thickness of the cutting surface 220.

Figure 32:
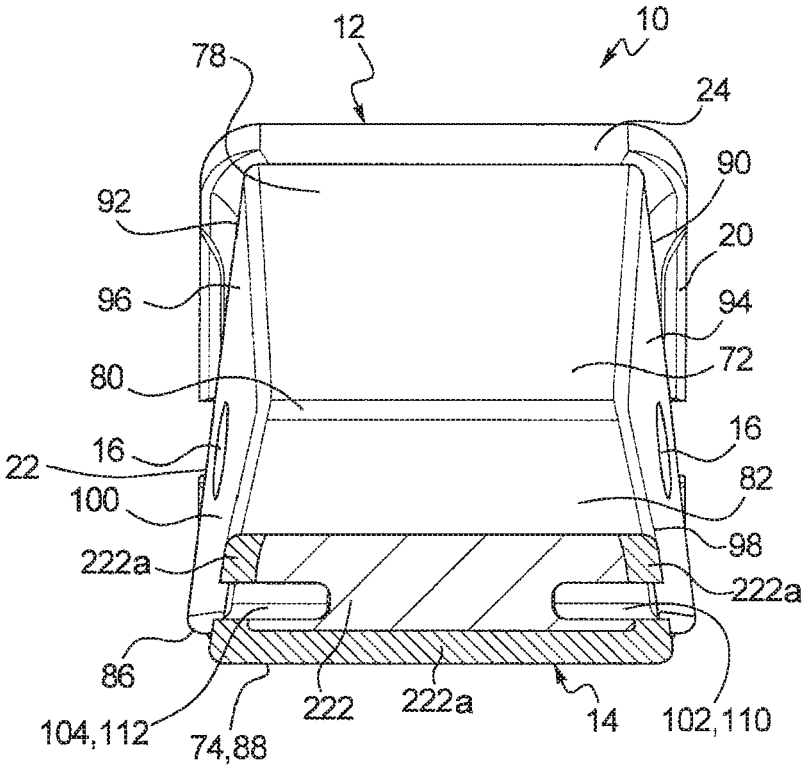
FIG. 32 is a cross-sectional view of the tooth assembly of FIG. 4 taken through line 22-22.

The wear material of the tip 14 continues to wear away rearwardly toward the reliefs 102, 104. FIG. 32 illustrates a cross-section of the tooth assembly 10 at a position where the front of the tip 14 may have worn away into the portion of the tip 14 providing the reliefs 102, 104 to form a cutting surface 222. At this point, the tip 14 may have worn through the curved portions 106, 108 of the relief's 102, 104 such that the cutting surface 222 includes an intermediate area of reduced width. The area of reduced width may cause the cutting surface 222 to have an I-shape, and to begin approaching a T-shape as the front portion 88 of the bottom outer surface 74 continues to wear away toward the bottom of the reliefs 102, 104 as indicated by the cross-hatched area 222*a*. The wear material removed from the cutting surface 222 by the reliefs 102, 104 reduces the cross-sectional area of the leading cutting surface 222 of the tip 14 to "sharpen" the tip 14, and correspondingly reduces the resistance experienced as the tip 14 of the implement 1, 6 enters the work material. The tapered portions 110, 112 of the reliefs 102, 104, respectively, allow the work material to flow through the reliefs 102, 104 with less resistance than if the rear portions of the reliefs 102, 104 were flat or rounded and facing more directly toward the work material. The tapering of the tapered portions 110, 112 reduces forces acting normal to the surfaces that may resist the flow of the work material and the penetration of the tip 14 into the work material.

Figure 33:
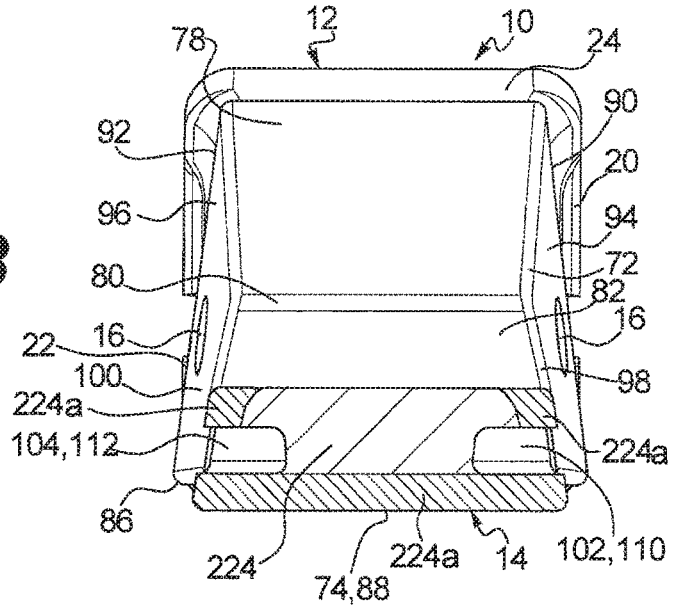
FIG. 33 is a cross-sectional view of the tooth assembly of FIG. 4 taken through line 33-33.
Figure 33A:
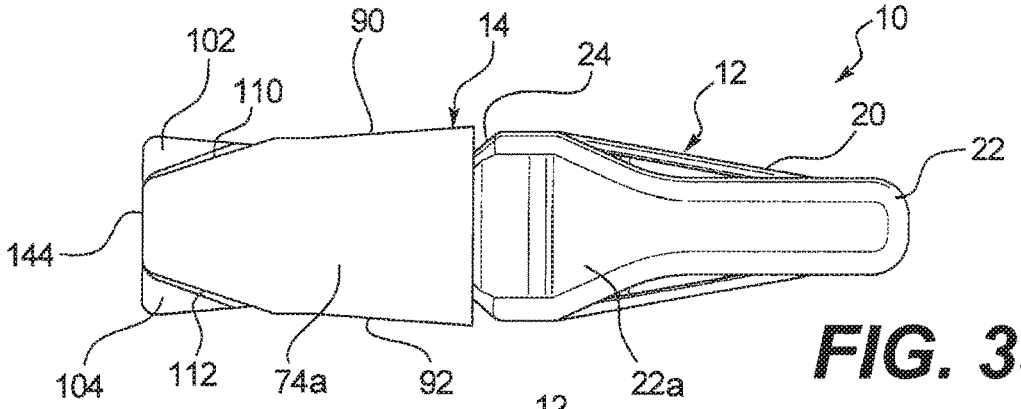
FIG. 33*a* is a bottom view of the tooth assembly of FIG. 3 with wear material worn away at the front and bottom of the tip to the cutting surface shown in FIG. 33.
Figure 34:
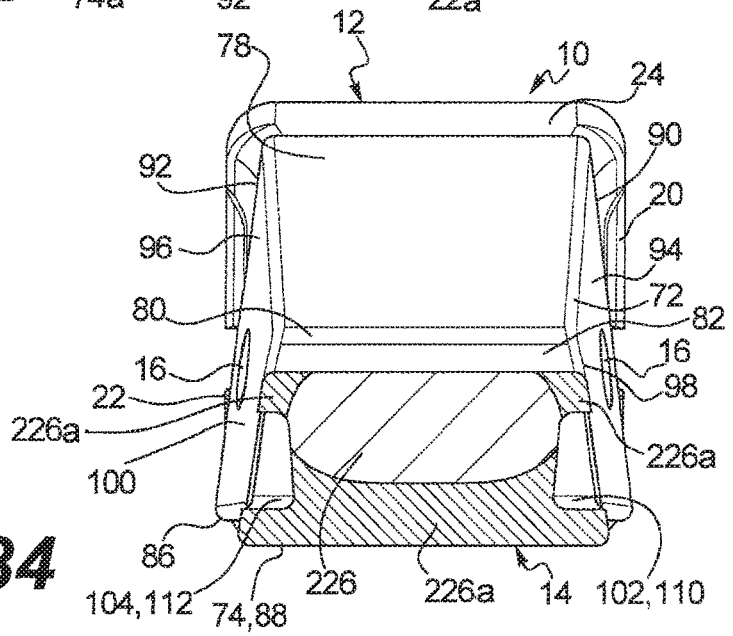
FIG. 34 is a cross-sectional view of the tooth assembly of FIG. 4 taken through line 34-34.

FIGS. 33 and 34 illustrate further iterations of cutting surfaces 224, 226, respectively, as wear material continues to wear away from the front end of the tip 14 and from the front portion 88 of the bottom outer surface 74. The reliefs 102, 104 may have generally triangular shapes corresponding to the wedge shape of the tip 14 formed by the top outer surface 72 and bottom outer surface 74. Consequently, the portions of the cutting surfaces 224, 226 defined by the reliefs 102, 104 may increase as the leading edge of the tip 14 progresses rearwardly. However, the area of reduced width also widens as the tapered portions 110, 112 approach the front portions 98, 100, respectively, of the lateral outer surfaces 90, 92. Eventually, wear material wears away from the front of the tip 14 to the rearwardly limits of the reliefs 102, 104. As indicated by the cross-hatched areas 224*a*, 226*a*, the front portion 88 of the bottom outer surface 74 may wear away up to the bottom of the reliefs 102, 104. At this point, the cutting surfaces 224, 226 more closely resemble T-shapes. FIG. 33*a* represents a bottom view of the tooth assembly 10 of FIG. 33 with the outer surfaces 72, 74, 90, 92 partially worn away. The bottom outer surface 74 may be worn down to an abraded bottom outer surface 74*a*, and a portion of the bottom strap 22 of the adapter 12 may be worn down to an abraded bottom surface 22*a*. With the bottom outer surface 74 worn up to the reliefs 102, 104 and the front of the tip 14 worn back to the cutting surface 224, the tapered portions 110, 112 of the reliefs 102, 104 combine with the cutting surface 224 to form a penetration tip-like taper facilitating penetration of the tip 14 into the work material.

Figure 35:
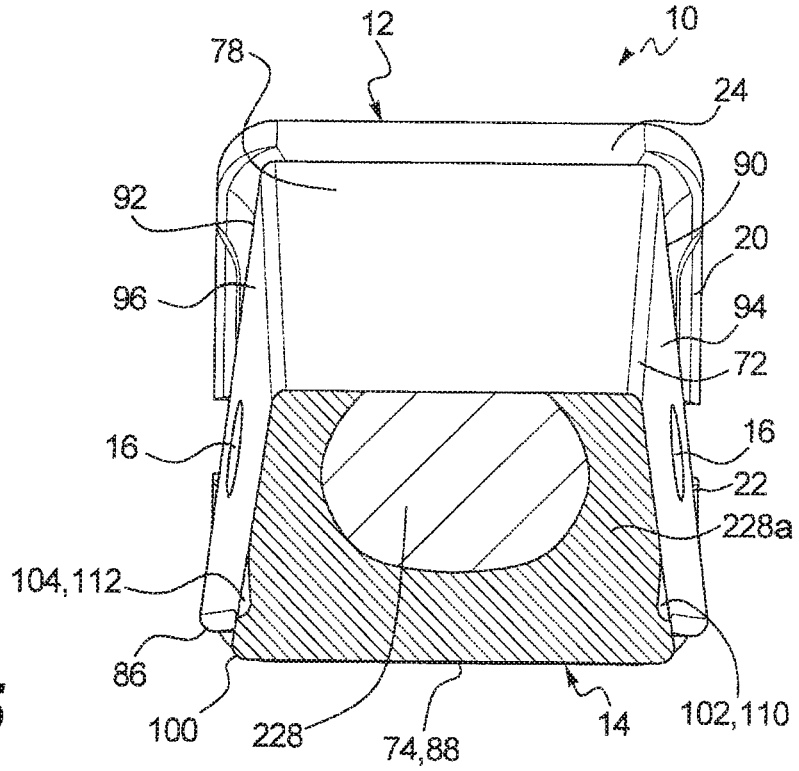
FIG. 35 is a cross-sectional view of the tooth assembly of FIG. 4 taken through line 35-35.
Figure 36:
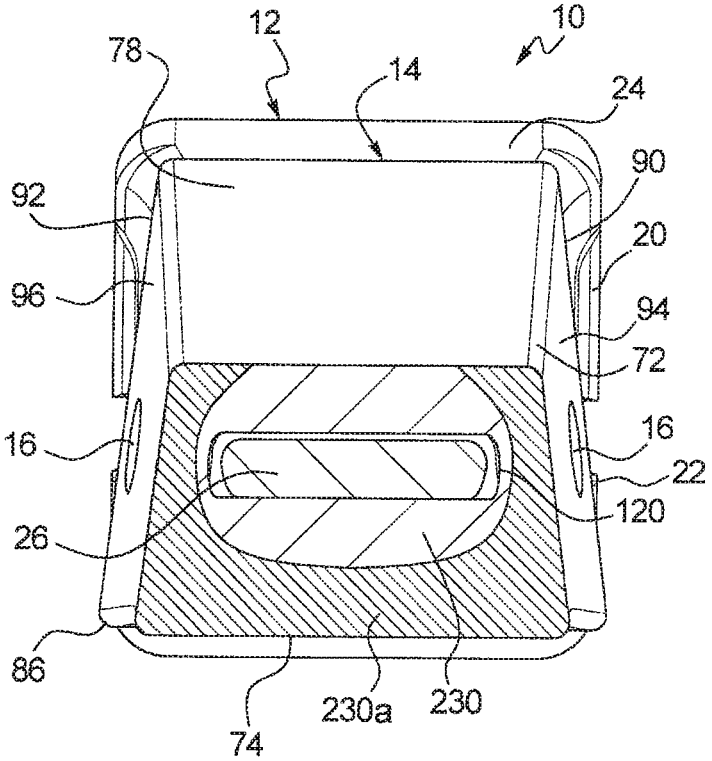
FIG. 36 is a cross-sectional view of the tooth assembly of FIG. 4 taken through line 36-36.

As shown in FIG. 35, a cutting surface 228 closely approximates the cross-sectional area of the tip 14 behind the reliefs 102, 104, thereby creating a relatively large surface area for attempted penetration of the work material. The large surface area may be partially reduced by wear indicated by the cross-hatched area 228*a*. The tip 14 begins to function less efficiently at cutting into the work material as the tip 14 nears the end of their useful life. Wearing away of the tip 14 beyond the reliefs 102, 104 may provide a visual indication for replacement of the tip 14. Continued use of the tip 14 causes further erosion of the wear material at the front of the tip 14, and may ultimately lead to a breach of the nose cavity 120 at a cutting surface 230 as shown in FIG. 36. Wear progressing inwardly from the outer surfaces 72, 74, 90, 92 as indicated by the cross-hatched area 230*a* may eventually cause further breaches of the nose cavity 120 with continued use of the tooth assembly 10. At this point, the nose 26 of the adapter 12 may be exposed to the work material, and may begin to wear away, possibly to the point where the adapter 12 must also be removed from the base edge 18 of the implement 1, 6 and replaced.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, not impossible. Numerous alternative embodiments could be implemented, using either current technology or technology developed after the filing date of this patent, which would still fall within the scope of the claims defining the invention.

What is claimed is:

1. A ground engaging tip of a tooth assembly for a cutting edge of a ground engaging implement, wherein the tooth assembly includes an adapter configured for attachment to a base edge of the ground engaging implement and having a forward extending adapter nose, the ground engaging tip comprising:

a rear edge;

a front edge;

a top outer surface;

a bottom outer surface extending forward from the rear edge toward a side transition area, wherein sides of the bottom outer surface converge toward one another as the bottom outer surface extends forward toward the side transition area, wherein the bottom outer surface extends forward from the side transition area toward the front edge, and the sides of the bottom outer surface diverge from one another as the bottom surface extends forward from the side transition area toward the front edge;

oppositely disposed lateral outer surfaces extending upwardly from the bottom outer surface to the top outer surface, the lateral outer surfaces including rear portions extending forward from the rear edge and front portions extending rearward from the front edge, the front portions of the lateral outer surfaces including reliefs extending inwardly from the lateral outer surfaces into a body of the ground engaging tip to define pockets, with the reliefs including forward curved portions extending inwardly into the body of the tip and rearward tapered portions extending toward the rear edge and diverging from each other; and an inner surface extending inwardly into the ground engaging tip from the rear edge and defining a nose cavity within the ground engaging tip having a shape complementary to a shape of the adapter nose for receiving the adapter nose therein.

2. The ground engaging tip of claim 1, wherein the rear edge defines a plane, wherein a converging side portion of the bottom outer surface and a first line perpendicular to the plane form a side taper angle, wherein a diverging side portion of the bottom outer surface and a second line perpendicular to the plane form a front taper angle, and wherein the side taper angle is greater than the front taper angle.

3. The ground engaging tip of claim 1, wherein the rear edge defines a plane, wherein a converging side portion of the bottom outer surface and a first line perpendicular to the plane form a side taper angle, wherein a diverging side portion of the bottom outer surface and a second line perpendicular to the plane form a front taper angle, and wherein the side taper angle is approximately 3°.

4. The ground engaging tip of claim 1, wherein the rear edge defines a plane, wherein a converging side portion of the bottom outer surface and a first line perpendicular to the plane form a side taper angle, wherein a diverging side portion of the bottom outer surface and a second line perpendicular to the plane form a front taper angle, wherein the front taper angle is greater than 0°.

5. The ground engaging tip of claim 1, wherein the rear portions extending forward from the rear edge are oriented such that a distance between the rear portions decreases as the rear portions approach the side transition area, and wherein the front portions extending forward from the side transition area are oriented such that a distance between the front portions increases as the front portions approach the front edge.

6. The ground engaging tip of claim 1, wherein the top outer surface extends forward from the rear edge toward the side transition area, wherein sides of the top outer surface converge toward one another as the top outer surface extends forward toward the side transition area, wherein the top outer surface extends from the side transition area to the front edge, and wherein the sides of the top outer surface diverge from one another as the top surface extends forward from the side transition area toward the front edge.

7. The ground engaging tip of claim 1, wherein the oppositely disposed lateral outer surfaces are tapered such that a distance between the lateral outer surfaces decreases as the lateral outer surfaces extend upwardly from the bottom outer surface toward the top outer surface.

8. A ground engaging tip for a cutting edge of a ground engaging implement, the ground engaging tip comprising:

a rear edge;

a front edge;

a top outer surface;

a bottom outer surface; and oppositely disposed lateral outer surfaces extending upwardly from the bottom outer surface to the top outer surface;

wherein the oppositely disposed lateral outer surfaces have rear portions extending forward from the rear edge and oriented such that a distance between the rear portions decreases as the rear portions approach a side transition area, and wherein the oppositely disposed lateral outer surfaces have front portions extending forward from the side transition area toward the front edge and oriented such that a distance between the front portions increases as the front portions approach the front edge, the front portions of the lateral outer surfaces including reliefs extending inwardly from the lateral outer surfaces into a body of the ground engaging tip to define pockets, with the reliefs including forward curved portions extending inwardly into the body of the tip and rearward tapered portions extending toward the rear edge and diverging from each other.

9. The ground engaging tip of claim 8, wherein the rear edge defines a plane, wherein a convergence of a rear portion of one of the oppositely disposed lateral outer surfaces and a first line perpendicular to the plane form a side taper angle, wherein a divergence of a front portion of the one of the oppositely disposed lateral outer surfaces and a second line perpendicular to the plane form a front taper angle, wherein the side taper angle is greater than the front taper angle.

10. The ground engaging tip of claim 8, wherein the rear edge defines a plane, wherein a convergence of a rear portion of one of the oppositely disposed lateral outer surfaces and a first line perpendicular to the plane form a side taper angle, wherein a divergence of a front portion of the one of the oppositely disposed lateral outer surfaces and a second line perpendicular to the plane form a front taper angle, wherein the side taper angle is approximately 3°.

11. The ground engaging tip of claim 8, wherein the rear edge defines a plane, wherein a convergence of a rear portion of one of the oppositely disposed lateral outer surfaces and a first line perpendicular to the plane form a side taper angle, wherein a divergence of a front portion of the one of the oppositely disposed lateral outer surfaces and a second line perpendicular to the plane form a front taper angle, wherein the front taper angle is greater than 0°.

12. The ground engaging tip of claim 8, wherein the bottom outer surface extends forward from the rear edge toward the side transition area, wherein sides of the bottom outer surface converge toward one another as the bottom outer surface extends forward toward the side transition area, wherein the bottom outer surface extends forward from the side transition area toward the front edge, and wherein the sides of the bottom outer surface diverge from one another as the bottom outer surface extends forward from the side transition area toward the front edge.

13. The ground engaging tip of claim 8, wherein the top outer surface extends forward from the rear edge toward the side transition area, wherein sides of the top outer surface converge toward one another as the top outer surface extends forward toward the side transition area, wherein the top outer surface extends from the side transition area to the front edge, and wherein the sides of the top outer surface diverge from one another as the top surface extends forward from the side transition area toward the front edge.

14. The ground engaging tip of claim 8, comprising an inner surface extending inwardly into the ground engaging tip from the rear edge and defining a nose cavity within the ground engaging tip having a shape complementary to a shape of an adapter nose for receiving the adapter nose therein.

15. The ground engaging tip of claim 8, wherein the oppositely disposed lateral outer surfaces are tapered such that a distance between the lateral outer surfaces decreases as the lateral outer surfaces extend upwardly from the bottom outer surface toward the top outer surface.

* * * * *